US011462168B2

(12) United States Patent
Liu et al.

(10) Patent No.: US 11,462,168 B2
(45) Date of Patent: Oct. 4, 2022

(54) PIXEL CIRCUIT AND DRIVING METHOD THEREOF, LIGHT-EMITTING CONTROL CIRCUIT, DISPLAY PANEL, AND DISPLAY DEVICE

(71) Applicant: Hubei Yangtze Industrial Innovation Center Of Advanced Display Co., Ltd., Wuhan (CN)

(72) Inventors: Chuan Liu, Wuhan (CN); Zhihua Yu, Wuhan (CN)

(73) Assignee: Hubei Yangtze Industrial Innovation Center Of Advanced Display Co., Ltd., Wuhan (CN)

( * ) Notice: Subject to any disclaimer, the term of this patent is extended or adjusted under 35 U.S.C. 154(b) by 0 days.

(21) Appl. No.: 17/220,038

(22) Filed: Apr. 1, 2021

(65) Prior Publication Data

US 2022/0208099 A1 Jun. 30, 2022

(30) Foreign Application Priority Data

Dec. 29, 2020 (CN) ..... 202011608037.4

(51) Int. Cl.
*G09G 3/3233* (2016.01)
*G09G 3/3266* (2016.01)
*G09G 3/3258* (2016.01)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3208; G09G 3/3233; G09G 3/3258; G09G 3/3266; G09G 2300/0439;
(Continued)

(56) References Cited

U.S. PATENT DOCUMENTS

2019/0311682 A1* 10/2019 Pyo ..... G09G 3/3233
2021/0174737 A1* 6/2021 Park ..... G09G 3/32
(Continued)

FOREIGN PATENT DOCUMENTS

CN 106558287 A 4/2017
CN 108877680 A 11/2018
(Continued)

*Primary Examiner* — Michael J Eurice
(74) *Attorney, Agent, or Firm* — Anova Law Group, PLLC

(57) ABSTRACT

A pixel circuit, a light-emitting control circuit, a driving method of a pixel circuit, a display panel, and a display device are provided. The pixel circuit includes an enabling module, a light-emitting control module, a first reset module, and a light-emitting element connected in series between a power voltage terminal and a common voltage terminal. The first reset module is electrically connected to a first terminal of the light-emitting element. The enabling module is configured to generate driving current, and the light-emitting control module is configured to transmit the driving current to the light-emitting element. The first reset module is configured to reset the first terminal of the light-emitting element. A control terminal of the light-emitting control module is configured to receive a first light-emitting control signal, and a control terminal of the first reset module is configured to receive a second light-emitting control signal.

21 Claims, 13 Drawing Sheets

(52) U.S. Cl.
CPC ..... *G09G 2310/0286* (2013.01); *G09G 2310/061* (2013.01); *G09G 2310/08* (2013.01)

(58) Field of Classification Search
CPC ... G09G 2300/0809; G09G 2300/0819; G09G 2300/0842; G09G 2310/0278; G09G 2310/0286; G09G 2310/061; G09G 2310/08; G09G 2320/02; G09G 2320/0214; G09G 2320/0233; G09G 2320/0242; G09G 2320/0257; G09G 2320/043; G09G 2320/045
See application file for complete search history.

(56) References Cited

U.S. PATENT DOCUMENTS

| | | | | |
|---|---|---|---|---|
| 2021/0201786 | A1* | 7/2021 | Ma | G09G 3/3233 |
| 2021/0304678 | A1* | 9/2021 | Wang | G09G 3/3233 |
| 2022/0044638 | A1* | 2/2022 | Kim | G09G 3/3266 |

FOREIGN PATENT DOCUMENTS

| | | | |
|---|---|---|---|
| CN | 108564920 | B | 11/2019 |
| CN | 110473503 | A | 11/2019 |

* cited by examiner

20

PIXEL CIRCUIT AND DRIVING METHOD THEREOF, LIGHT-EMITTING CONTROL CIRCUIT, DISPLAY PANEL, AND DISPLAY DEVICE

CROSS-REFERENCE TO RELATED APPLICATION

This application claims priority of Chinese Patent Application No. 202011608037.4, filed on Dec. 29, 2020, the entire content of which is hereby incorporated by reference.

FIELD OF THE DISCLOSURE

The present disclosure generally relates to the field of display technology and, more particularly, relates to a pixel circuit, a light-emitting control circuit, and a driving method of a pixel circuit, a display panel, and a display device.

BACKGROUND

An organic light-emitting diode (OLED) display panel, as a flat display panel, may have advantages of high image quality, low power consumption, a thin body, and a wide application range. Accordingly, OLED display panels are widely used in various consumer electronic products including mobile phones, televisions, personal digital assistants, digital cameras, notebook computers, desktop computers, and have become a mainstream of display panels.

An OLED display panel may include a common layer, for example, a common layer in contact with an anode of an OLED light-emitting element. Since the common layer has electrical conductivity, when controlling a certain sub-pixel to emit light, lateral leakage current may appear. As such, other sub-pixels may stealthily emit light, resulting in color cast on the display panel.

Color cast of a display panel has become a technical problem that urgently needs to be solved by those skilled in the art. The disclosed structures and methods are directed to solve one or more problems set forth above and other problems in the art.

SUMMARY

One aspect of the present disclosure includes a pixel circuit. The pixel circuit includes an enabling module, a light-emitting control module, a first reset module, and a light-emitting element. The enabling module, the light-emitting control module, and the light-emitting element are connected in series between a power voltage terminal and a common voltage terminal. The first reset module is electrically connected to a first terminal of the light-emitting element. The enabling module is configured to generate driving current, and the light-emitting control module is configured to transmit the driving current to the light-emitting element. The first reset module is configured to reset the first terminal of the light-emitting element. A control terminal of the light-emitting control module is configured to receive a first light-emitting control signal, and a control terminal of the first reset module is configured to receive a second light-emitting control signal. The first light-emitting control signal and the second light-emitting control signal are generated by a light-emitting control circuit. When the light-emitting control module is at a turn-off state, the first reset module is at a turn-on state, and when the light-emitting control module is at a turn-on state, the first reset module is at a turn-off state.

Another aspect of the present disclosure includes a display panel. The display panel includes a pixel circuit and a light-emitting control circuit. The pixel circuit includes an enabling module, a light-emitting control module, a first reset module, and a light-emitting element. The enabling module, the light-emitting control module, and the light-emitting element are connected in series between a power voltage terminal and a common voltage terminal, and the first reset module is electrically connected to a first terminal of the light-emitting element. The enabling module is configured to generate driving current, the light-emitting control module is configured to transmit the driving current to the light-emitting element, and the first reset module is configured to reset the first terminal of the light-emitting element. A control terminal of the light-emitting control module is configured to receive a first light-emitting control signal, and a control terminal of the first reset module is configured to receive a second light-emitting control signal. When the light-emitting control module is in a turn-off state, the first reset module is in a turn-on state, and when the light-emitting control module is in a turn-on state, the first reset module is in a turn-off state. The light-emitting control circuit includes a plurality of shift registers connected in cascade, and each shift register of the plurality of shift registers includes an output control module and an inversion control module. The output control module includes a first output signal terminal, the inversion control module includes a second output signal terminal, and the first output signal terminal is electrically connected to a control terminal of the inversion control module. The first output signal terminal in the shift register is electrically connected to a control terminal of one of the light-emitting control module and the first reset module in the pixel circuit, and the second output signal terminal in the shift register is electrically connected to a control terminal of an other of the light-emitting control module and the first reset module in the pixel circuit.

Another aspect of the present disclosure includes a display device. The display device includes a display panel. The display panel includes a pixel circuit and a light-emitting control circuit. The pixel circuit includes an enabling module, a light-emitting control module, a first reset module, and a light-emitting element. The enabling module, the light-emitting control module, and the light-emitting element are connected in series between a power voltage terminal and a common voltage terminal, and the first reset module is electrically connected to a first terminal of the light-emitting element. The enabling module is configured to generate driving current, the light-emitting control module is configured to transmit the driving current to the light-emitting element, and the first reset module is configured to reset the first terminal of the light-emitting element. A control terminal of the light-emitting control module is configured to receive a first light-emitting control signal, and a control terminal of the first reset module is configured to receive a second light-emitting control signal. When the light-emitting control module is in a turn-off state, the first reset module is in a turn-on state, and when the light-emitting control module is in a turn-on state, the first reset module is in a turn-off state. The light-emitting control circuit includes a plurality of shift registers connected in cascade, and each shift register of the plurality of shift registers includes an output control module and an inversion control module. The output control module includes a first output signal terminal, the inversion control module includes a second output signal terminal, and the first output signal terminal is electrically connected to a control terminal of the inversion control module. The first output signal terminal in the shift register is electrically connected to a control terminal of one of the light-emitting control module and the first reset module in the pixel circuit, and the second output signal terminal in the shift register is electrically connected to a control terminal of an other of the light-emitting control module and the first reset module in the pixel circuit.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

To make the objectives, technical solutions and advantages of the present disclosure clearer and more explicit, the present disclosure is described in further detail with accompanying drawings and embodiments. It should be understood that the specific exemplary embodiments described herein are only for explaining the present disclosure and are not intended to limit the present disclosure.

Reference will now be made in detail to exemplary embodiments of the present disclosure, which are illustrated in the accompanying drawings. Wherever possible, the same reference numbers will be used throughout the drawings to refer to the same or like parts.

It should be noted that relative arrangements of components and steps, numerical expressions and numerical values set forth in exemplary embodiments are for illustration purpose only and are not intended to limit the present disclosure unless otherwise specified. Techniques, methods and apparatus known to the skilled in the relevant art may not be discussed in detail, but these techniques, methods and apparatus should be considered as a part of the specification, where appropriate.

It should be noted that in the present disclosure, relational terms such as "first" and "second" are used only to distinguish one entity or operation from another entity or operation, and do not necessarily require or imply any such actual relationship or order between these entities or operations. Moreover, terms "include", "comprise" or any other variations thereof are intended to cover non-exclusive inclusion. A process, a method, an article, or an equipment including a series of elements may not only include those elements, but also include other elements that are not explicitly listed, or elements inherent to the process, the method, the article, or the equipment. Without additional restrictions, when a phrase "including . . . " is used to identify an element, other identical elements may exist in a process, a method, an article, or an equipment including the element.

It should be understood that, in describing a structure of a component, when a layer or an region is referred to as being "on" or "above" another layer or another region, the layer or the region may be directly on the other layer or the other region, or additional layers or additional regions may be included between the layer or the region and the other layer or the other region. Moreover, if the component is turned over, the layer or the region is "below" or "under" the other layer or the other region.

Figure 1:
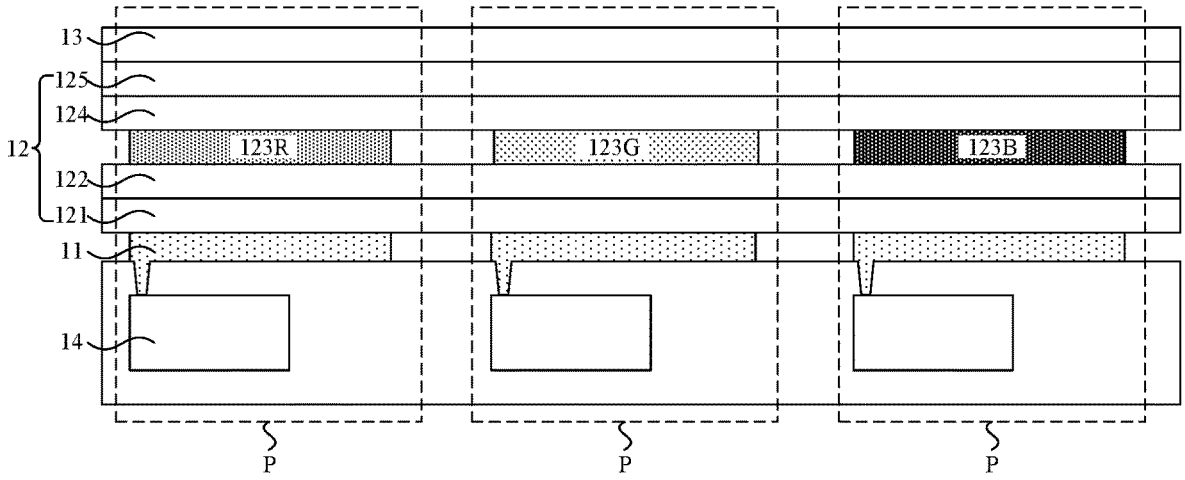
FIG. 1 illustrates a schematic structural diagram of a sub-pixel consistent with the disclosed embodiments of the present disclosure.

FIG. 1 illustrates a schematic structural diagram of a sub-pixel consistent with the disclosed embodiments of the present disclosure. As shown in FIG. 1, a sub-pixel P may include an anode 11, a light-emitting functional layer 12, a cathode 13, and a pixel circuit 14 connected to the anode 11. The anode 11, the light-emitting functional layer 12, the cathode 13, and the pixel circuit 14 are stacked in layers. The light-emitting function layer 12 includes a hole injection layer 121, a hole transport layer 122, a light-emitting layer 123R/123G/123B, an electron transport layer 124, and an electron injection layer 125 that are stacked in layers. The light-emitting layer 123R/123G/123B may be fabricated by using a fine metal mask (FMM) process, such that the light-emitting layers of the sub-pixels 10 are spaced apart from each other. The hole injection layer 121, the hole transport layer 122, the electron transport layer 124, and the electron injection layer 125 may be fabricated by using a common metal mask (CMM) process, such that the hole injection layers 121 of the sub-pixels P are connected to each other. The hole injection layer 121 may be understood as a common layer (Common). Also, the hole transport layer 122, the electron transport layer 124, and the electron injection layer 125 may each be understood as a common layer (Common).

Figure 2:
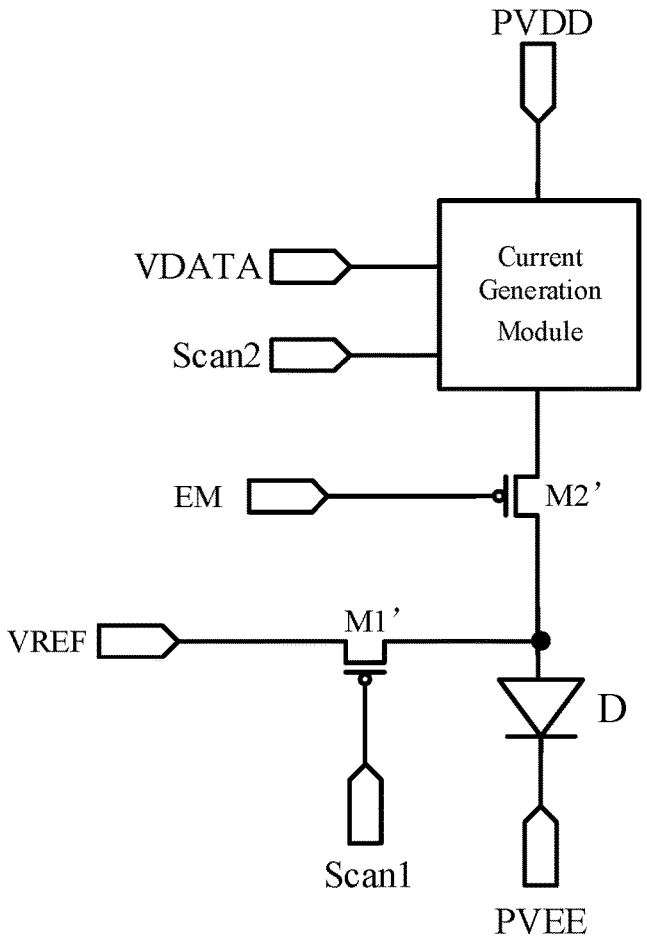
FIG. 2 illustrates a schematic structural diagram of a pixel circuit in a related art.

FIG. 2 illustrates a schematic structural diagram of a pixel circuit in a related art. In the pixel circuit 14, as shown in FIG. 2, a current generation module, a transistor M2' and a light-emitting element D are connected in series between a power voltage terminal PVDD and a voltage terminal PVEE. The current generation module is connected to a data signal terminal VDATA and a scan signal terminal Scan2. A gate of the transistor M2' is connected to a light-emitting control signal terminal EM. A gate of a transistor M1' is connected to a scan signal terminal Scan1. A first terminal of the transistor M1' is connected to a reset signal terminal VREF, and a second terminal of the transistor M1' is connected to an anode of the light-emitting element D.

Figure 3:
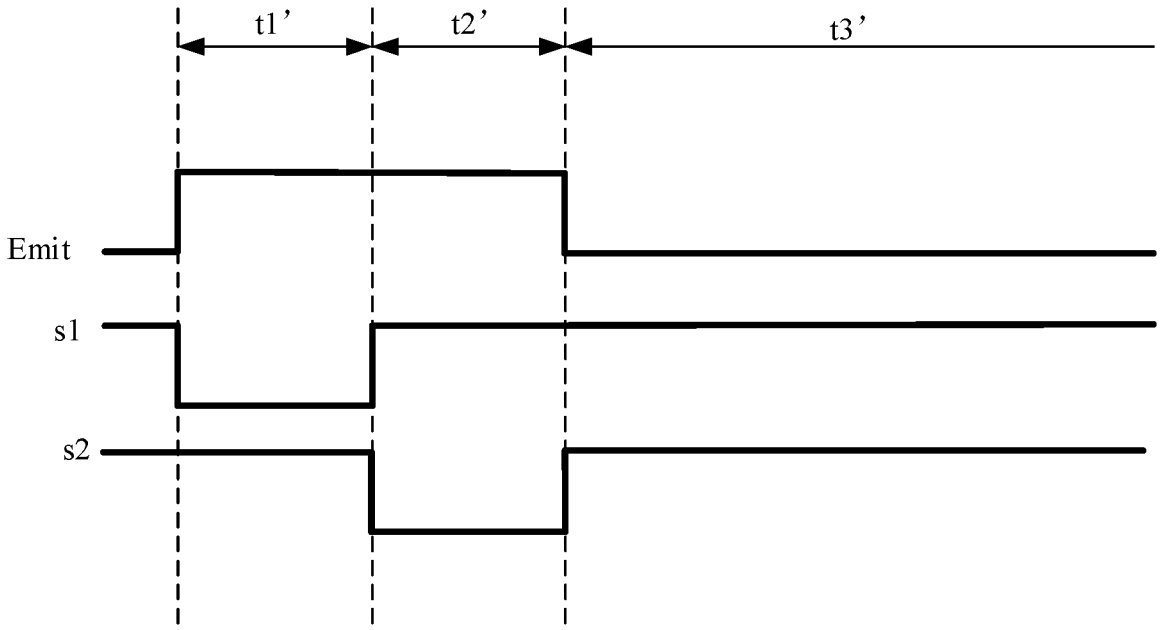
FIG. 3 illustrates a timing diagram of FIG. 2.

FIG. 3 illustrates a timing diagram of FIG. 2. In one embodiment, as an example, the transistors M1' and M2' are each a P-type transistor. The scan signal terminal Scan1 provides a scan signal s1, the scan signal terminal Scan2 provides a scan signal s2, and the light-emitting control signal terminal EM provides a light-emitting control signal Emit. As shown in FIG. 3, at a t1' stage, the scan signal terminal Scan1 provides a low voltage, and the transistor M1' is turned on. A reset signal provided by the reset signal terminal VREF is transmitted to the anode of the light-emitting element D to reset the anode of the light-emitting element D. When controlling a sub-pixel to emit light (that is, at a light-emitting stage t3'), lateral leakage current may appear. Since the anode of the light-emitting element D is in contact with common layers having conductivity, including the hole injection layer 121 and the hole transport layer 122, the leakage current may pass through the common layers and reach the anodes of the light-emitting elements D of other sub-pixels. Accordingly, in stages other than the t1' stage, the anode of the light-emitting element D may accumulate electric charge. Thus, some sub-pixels may stealthily emit light when these sub-pixels should not emit light, resulting in color cast on the display panel.

The present disclosure provides a pixel circuit, a light-emitting control circuit, a driving method of a pixel circuit, a display panel, and a display device. As described below, the pixel circuit, the light-emitting control circuit, the driving method of a pixel circuit, the display panel, and the display device of the present disclosure may be presented in various forms.

Figure 4:
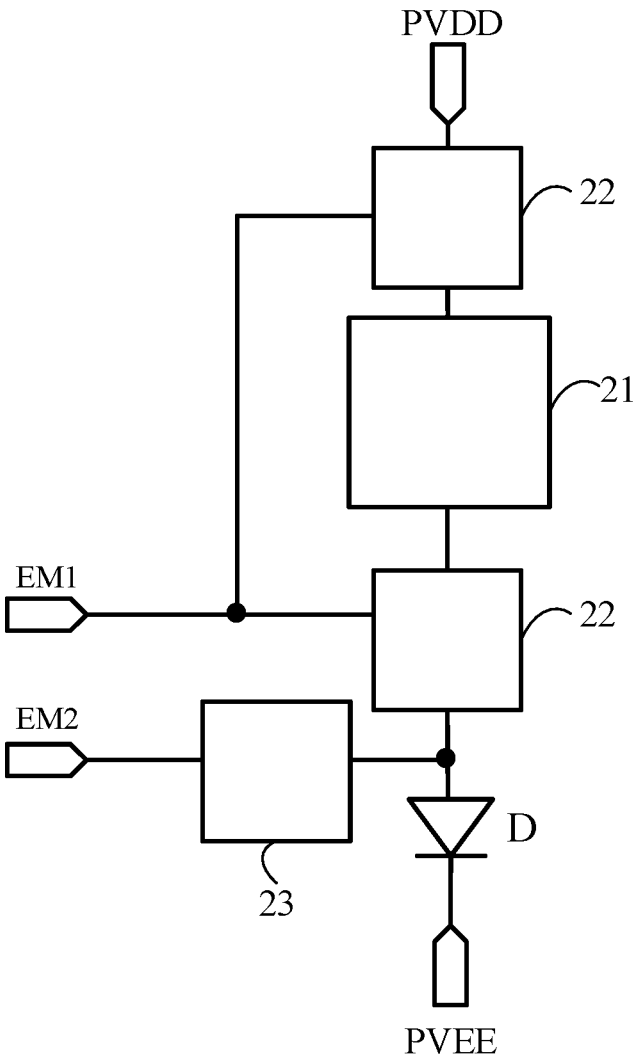
FIG. 4 illustrates a schematic structural diagram of a pixel circuit consistent with the disclosed embodiments of the present disclosure.

FIG. 4 illustrates a schematic structural diagram of a pixel circuit consistent with the disclosed embodiments of the present disclosure. As shown in FIG. 4, the pixel circuit 20 includes an enabling module 21, a light-emitting control module 22, a first reset module 23, and a light-emitting element D.

The enabling module 21, the light-emitting control module 22, and the light-emitting element D are connected in series between a power voltage terminal PVDD and a common voltage terminal PVEE. The first reset module 23 is electrically connected to a first terminal of the light-emitting element D. The enabling module 21 is configured to generate a driving current, and the light-emitting control module 22 is configured to transmit the driving current to the light-emitting element D. The first reset module 23 is configured to reset the first terminal of the light-emitting element D.

In one embodiment, the pixel circuit may include two light-emitting control modules 22. One light-emitting control module 22 is connected in series between the power voltage terminal PVDD and the enabling module 21. The other light-emitting control module 22 is connected in series between the enabling module 21 and the light-emitting element D. In one embodiment, the first terminal of the light-emitting element D may be an anode, and the second terminal of the light-emitting element D may be a cathode. A second terminal of the light-emitting element D is electrically connected to the common voltage terminal PVEE.

A control terminal of the light control module 22 is configured to receive a first light-emitting control signal em1. A control terminal of the first reset module 23 is configured to receive a second light-emitting control signal em2. The first light-emitting control signal em1 and the second light-emitting control signal em2 are generated by a light-emitting control circuit. In one embodiment, the light-emitting control circuit may include a first output signal terminal EM1 and a second output signal terminal EM2. The control terminal of the light-emitting control module 22 is electrically connected to the first output signal terminal EM1, and the control terminal of the first reset module 23 is electrically connected to the second output signal terminal EM2. The first output signal terminal EM1 may output the first light-emitting control signal em1, and the second output signal terminal EM2 may output the second light-emitting control signal em2.

It may be understood that, since the first light-emitting control signal em1 and the second light-emitting control signal em2 come from the light-emitting control circuit, the first light-emitting control signal em1 and the second light-emitting control signal em2 are different from the scan signal from a scan driving circuit.

In one embodiment, when the light-emitting control module 22 is at a turn-off state, the first reset module 23 is at a turn-on state. When the light-emitting control module 22 is at a turn-on state, the first reset module 23 is at a turn-off state. In other words, states of the light-emitting control module 22 and the first reset module 23 are opposite at a same time. When the light-emitting control module 22 is at a turn-on state, driving current generated by the enabling module 21 may be transmitted to the light-emitting element D, and the light-emitting element D may thus emit light. When the light-emitting control module 22 is at a turn-off state, the light-emitting element D is at a non-light-emitting state, and the first reset module 23 is at a turn-on state, such that the first reset module 23 may reset the light-emitting element D. In other words, when the light-emitting element D is at a non-light-emitting state, the first reset module 23 may reset the light-emitting element D, and thus an anode of the light-emitting element D may be prevented from accumulating charge due to leakage current. In this way, some light-emitting elements may be prevented from stealthily emitting light when these light-emitting elements should not emit light, and color cast of the display panel may thus be avoided.

In one embodiment, a voltage of the power voltage terminal PVDD may be greater than a voltage of the common voltage terminal PVEE. A cross voltage between the power voltage terminal PVDD and the common voltage terminal PVEE may be 7V. For example, the voltage of the power voltage terminal PVDD is 3.5V, and the voltage of the common voltage terminal PVEE is −3.5V. In some embodiments, power consumption of the display panel may be decreased by reducing the across voltage between the power voltage terminal PVDD and the common voltage terminal PVEE. For example, the voltage of the power voltage terminal PVDD is 3.3V, and the voltage of the common voltage terminal PVEE is −3.3V. That is, the across voltage between the power voltage terminal PVDD and the common voltage terminal PVEE may be 6.6V.

Figure 5:
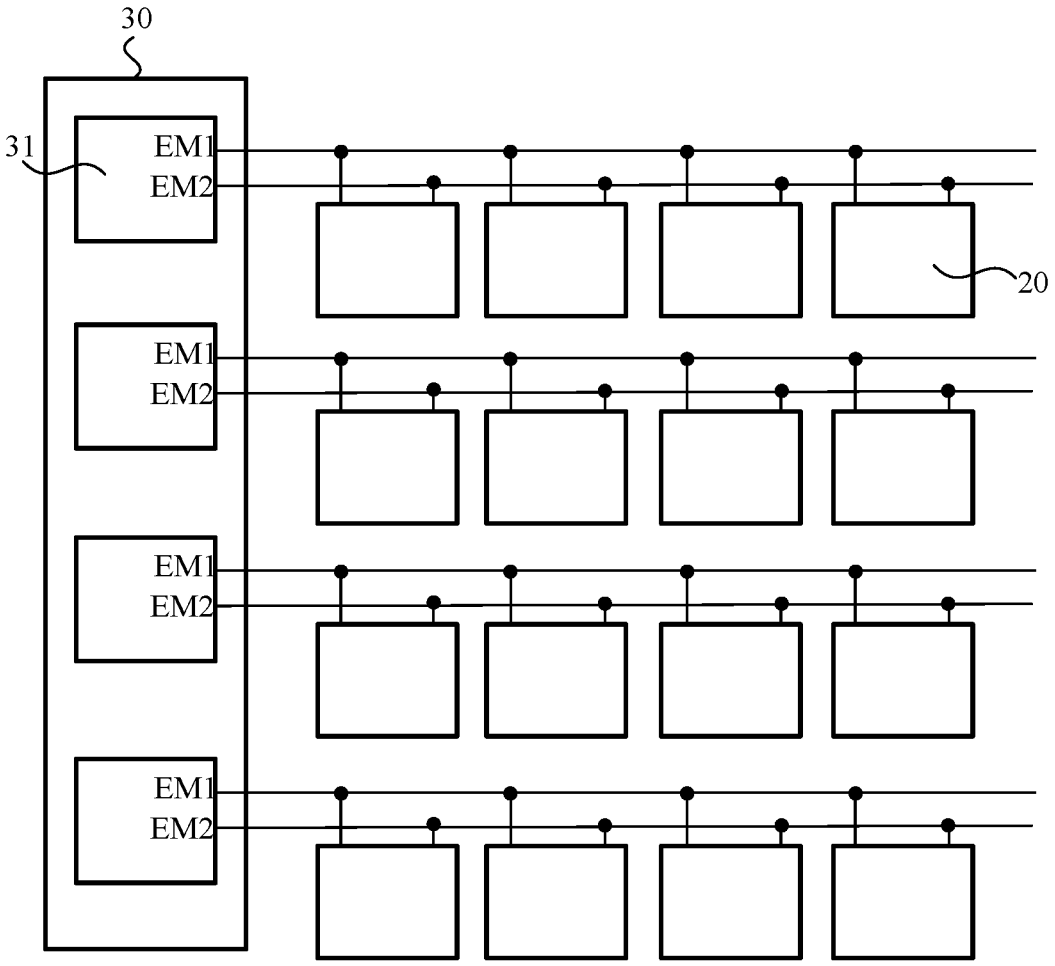
FIG. 5 illustrates a schematic diagram of connection between a pixel circuit and a light-emitting control circuit consistent with the disclosed embodiments of the present disclosure.

FIG. 5 illustrates a schematic diagram of connection between a pixel circuit and a light-emitting control circuit. In some embodiments, as shown in FIG. 5, the light-emitting control circuit 30 of the display panel may include a plurality of shift registers 31. The display panel may include a plurality of pixel circuits 20. The first light-emitting control signal and the second light-emitting control signal received by a same pixel circuit 20 are generated by a same shift register 31 in the light-emitting control circuit 30. In other words, the control terminal of the light-emitting control module 22 and the control terminal of the first reset module 23 in a same pixel circuit 20 are electrically connected to a same shift register 31.

In one embodiment, a quantity of rows of pixel circuits 20 in the display panel may be same as a quantity of shift registers 31 in the light-emitting control circuit 30. A same shift register 31 may be electrically connected to the pixel circuits 20 in a same row. That is, a same shift register 31 may provide the first light-emitting control signal and the second light-emitting control signal to the pixel circuits 20 in a same row simultaneously.

In one embodiment, the shift registers 31 in the light-emitting control circuit 30 may each include a first output signal terminal EM1 and a second output signal terminal EM2. The first output signal terminal EM1 of a same shift register 31 is electrically connected to the control terminal of the light-emitting control module 22 in each pixel circuit 20 in a same row. The second output signal terminal EM2 of a same shift register 31 is electrically connected to the control terminal of the first reset module 23 in each pixel circuit 20 in a same row.

In the present disclosure, the first light-emitting control signal and the second light-emitting control signal received by a same pixel circuit come from a same shift register. In other words, a same shift register may simultaneously generate the first light-emitting control signal and the second light-emitting control signal. Compared with a configuration where a same shift register may only generate one light-emitting control signal, the present disclosure may simplify a structure of the light-emitting control circuit.

The light-emitting control module 22 and the first reset module 23 may each include a transistor. In some embodiments, the transistor of the light-emitting control module 22 and the transistor of the first reset module 23 may have a same type. For example, the transistors of the light-emitting control module 22 and the first reset module 23 are each a P-type transistor, or, the transistors of the light-emitting control module 22 and the first reset module 23 are each an N-type transistor. A conduction voltage of the P-type transistor is a low voltage, and a conduction voltage of the N-type transistor is a high voltage. When the transistors in the light-emitting control module 22 and the first reset module 23 are of a same type, to make the light-emitting control module 22 and the first reset module 23 have opposite states simultaneously, voltages of the first light-emitting control signal and the second light-emitting control signal are opposite at a same time.

In some other embodiments, the transistor of the light-emitting control module 22 and the transistor of the first reset module 23 may have different types. One of the light-emitting control module 22 and the first reset module 23 may include a P-type transistor, and an other of the light-emitting control module 22 and the first reset module 23 may include an N-type transistor. For example, the light-emitting control module 22 includes a P-type transistor, and the first reset module 23 includes an N-type transistor. Or, the light-emitting control module 22 includes an N-type transistor, and the first reset module 23 includes a P-type transistor. Since one of the light-emitting control module 22 and the first reset module 23 includes a P-type transistor, and an other of the light-emitting control module 22 and the first reset module 23 includes an N-type transistor, by making the voltages of the first lighting control signal and the second lighting control signal be same at a same time, states of the lighting control module 22 and the first reset module 23 may be opposite simultaneously.

Figure 6:
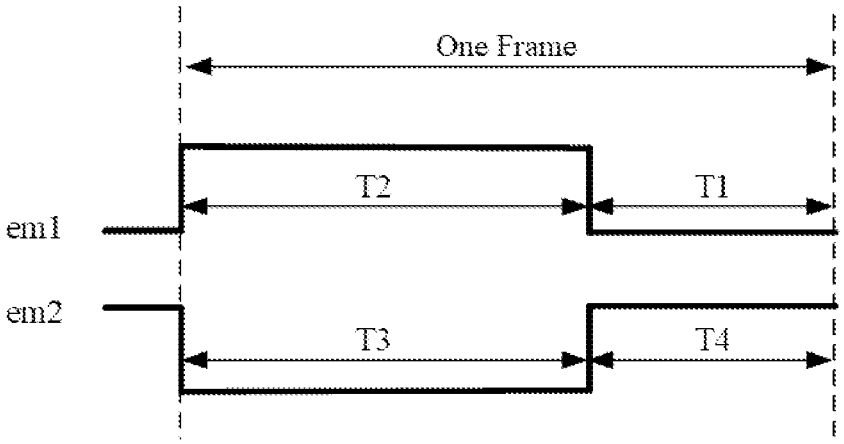
FIG. 6 illustrates a timing diagram of a light-emitting control signal consistent with the disclosed embodiments of the present disclosure.

In some embodiments, when the display panel displays a low-gray-scale image, light-emitting brightness may be adjusted by controlling a light-emitting duration of the light-emitting element. For example, the light-emitting duration of the light-emitting element within a time length of a frame may be reduced, and thus the brightness of the light-emitting element may be reduced to meet a low-brightness requirement of a low-gray-scale picture. FIG. 6 illustrates a timing diagram of a light-emitting control signal consistent with the disclosed embodiments of the present disclosure. As shown in FIG. 6, within a time length of a frame, in a period T1, the first light-emitting control signal em1 is at an on level, and in a period T2, the first light-emitting control signal em1 is at an off level, where the period T1 is shorter than or equal to the period T2. As shown in FIG. 6, within a time length of a frame, in a period T3, the second light-emitting control signal em2 is at a turn-on voltage, and in a period T4, the second light-emitting control signal em2 is at a turn-off voltage, where the period T3 is longer than or equal to the period T4.

FIG. 6 exemplarily shows that the turn-on voltages of the first light-emitting control signal em1 and the second light-emitting control signal em2 are each a low voltage, and the turn-off voltages of the first light-emitting control signal em1 and the second light-emitting control signal em2 are each a high voltage. FIG. 6 is not intended to limit the present disclosure.

It may be understood that when the first light-emitting control signal em1 is at a turn-on voltage, the light-emitting control module 22 is in a turn-on state. The driving current generated by the enabling module 21 may be transmitted to the light-emitting element D, and the light-emitting element D may emit light. When the first light-emitting control signal em1 is at a turn-off voltage, the light-emitting control module 22 is in a turn-off state. No driving current may be transmitted to the light-emitting element D, and the light-emitting element D may not emit light.

Within a time length of a frame, in the period T1, the first light-emitting control signal em1 is at an on level, and in the period T2, the first light-emitting control signal em1 is at an off level, where the period T1 is shorter than or equal to the period T2. Since the light emission period of the light-emitting element D may be reduced, the light-emitting brightness of the light-emitting element D may be reduced, and thus the low-brightness requirements of low-grayscale images may be met.

When the second light-emitting control signal em2 is at the turn-on voltage, the first reset module 23 is in the on state, the light-emitting element D does not emit light, and the first reset module 23 may reset the light-emitting element D. In addition, within a time length of a frame, when the light-emitting element D is in a non-lighting state for a long period of time, the first reset module 23 may reset the light-emitting element D.

In addition, the states of the light-emitting control module 22 and the first reset module 23 are opposite at a same time. Accordingly, within a time length of a frame, the period T1 is equal to the period T4. In the period T1, the first light-emitting control signal em1 is at the turn-on voltage, and in the period T4, the second light-emitting control signal em2 is at the turn-off voltage. The period T2 is equal to the period T3. In the period T2, the first light-emitting control signal em1 is at the turn-off voltage, and in the period T3, the second light-emitting control signal em2 is at the turn-on voltage.

Figure 7:
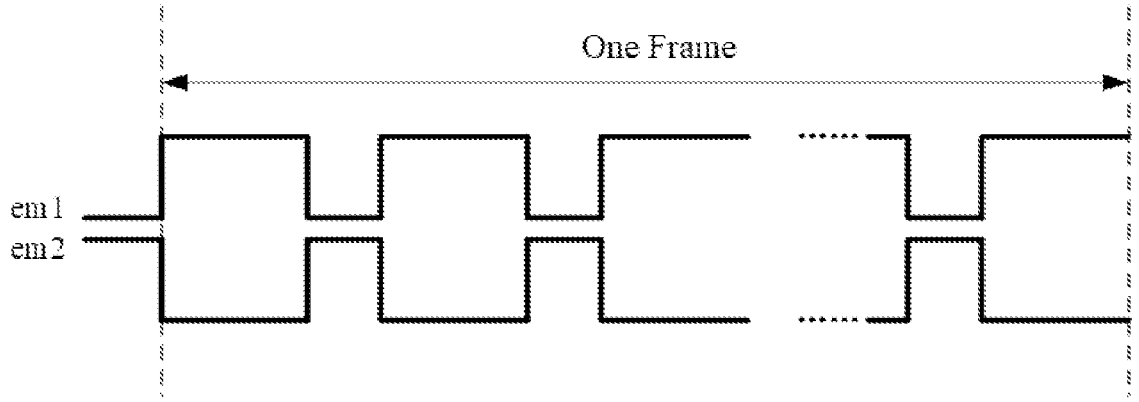
FIG. 7 illustrates another timing diagram of a light-emitting control signal consistent with the disclosed embodiments of the present disclosure.

FIG. 7 illustrates another timing diagram of a light-emitting control signal. In some embodiments, as shown in FIG. 7, as an example, the turn-on voltages of the first light-emitting control signal em1 and the second light-emitting control signal em2 are each a low voltage, and the turn-off voltages of the first light-emitting control signal em1 and the second light-emitting control signal em2 are each a high voltage. Within a time length of a frame, the first light-emitting control signal em1 may be alternately at a turn-off voltage and a turn-on voltage. The second light-emitting control signal em2 may be alternately at a turn-on voltage and a turn-off voltage.

Since the first light-emitting control signal em1 may be alternately at a turn-off voltage and a turn-on voltage, the light-emitting control module 22 may be alternately at a turn-off state and a turn-on state, and the light-emitting element D may thus be alternately at non-light-emitting state and a light-emitting state. Accordingly, the light-emitting duration of the light-emitting element D may be reduced to decrease the light-emitting brightness of the light-emitting element D, and meanwhile, light-emitting uniformity of the light-emitting element D within a time length of a frame may be improved.

Figure 8:
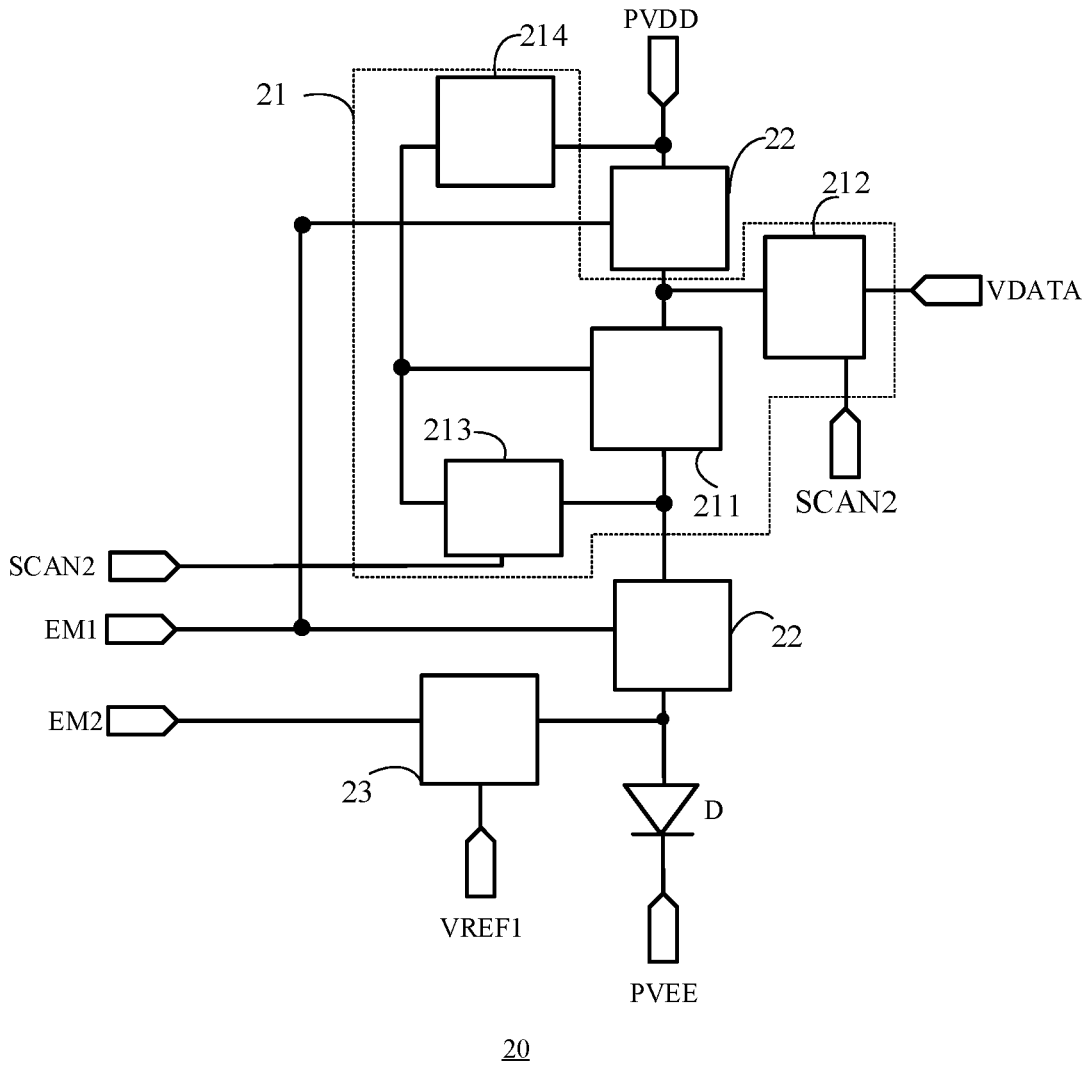
FIG. 8 illustrates another schematic structural diagram of a pixel circuit consistent with the disclosed embodiments of the present disclosure.

FIG. 8 illustrates another schematic structural diagram of a pixel circuit. In some embodiments, as shown in FIG. 8, the enabling module 21 may include a driving submodule 211, a data writing submodule 212, a threshold compensation submodule 213, and a storage submodule 214. The data writing submodule 212 is electrically connected to the driving submodule 211, and is configured to write a data voltage to the driving sub-module 211. The threshold compensation submodule 213 is electrically connected to a control terminal of the driving submodule 211. The threshold compensation sub-module 213 is configured to detect and compensate a threshold voltage deviation in the driving sub-module 211. The driving submodule 211 is configured to generate a driving current according to the data voltage. The storage submodule 214 is electrically connected to a control terminal of the driving submodule 211. The storage submodule 214 is configured to maintain the voltage of the control terminal of the driving submodule 211.

In one embodiment, a control terminal of the data writing submodule 212 may be electrically connected to a second scan signal terminal SCAN2, and an input terminal of the data writing submodule 212 may be electrically connected to the data signal terminal VDATA. A control terminal of the threshold compensation sub-module 213 may be electrically connected to the second scan signal terminal SCAN2.

Figure 9:
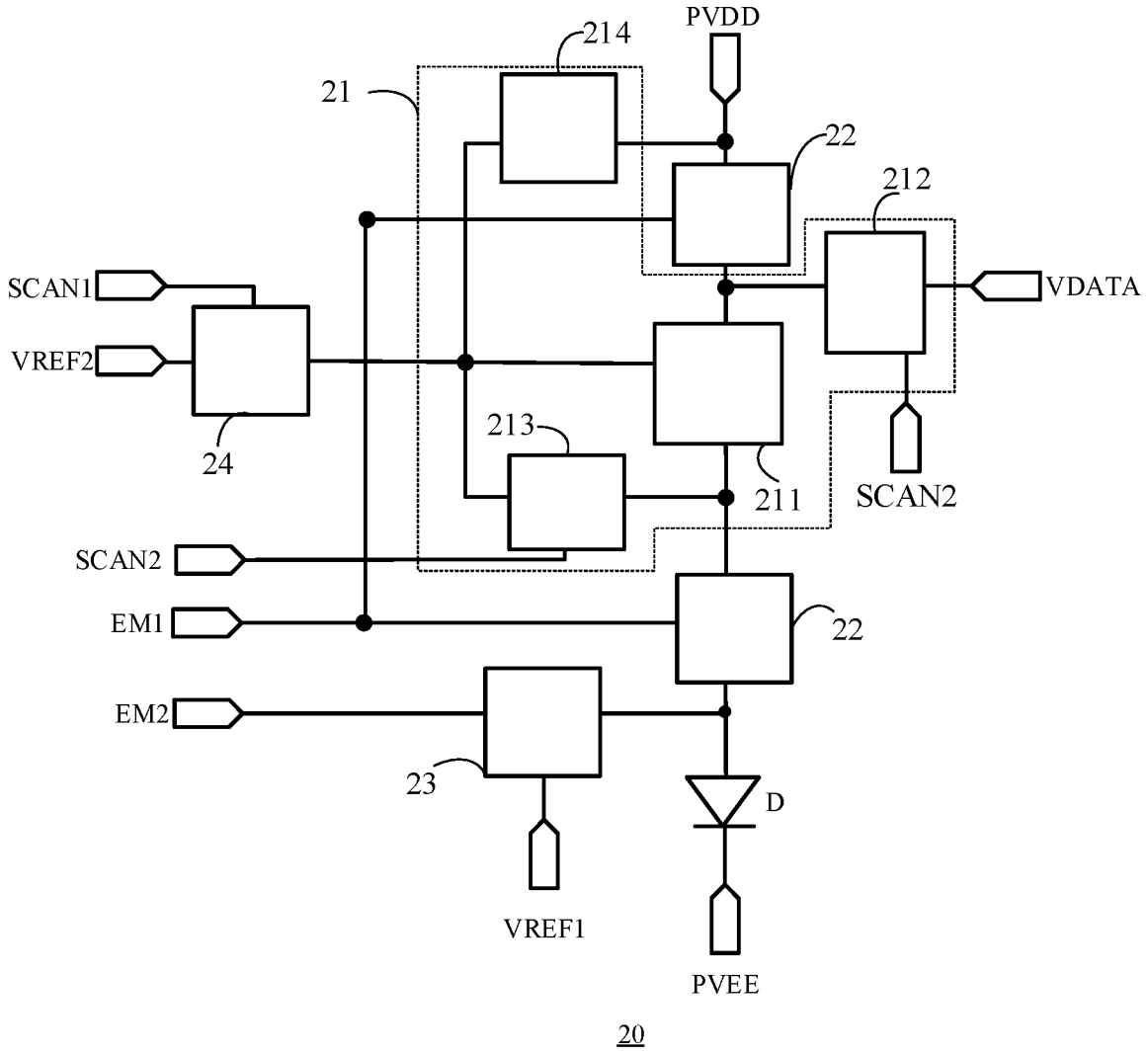
FIG. 9 illustrates another schematic structural diagram of a pixel circuit consistent with the disclosed embodiments of the present disclosure.

FIG. 9 illustrates another schematic structural diagram of a pixel circuit. In some embodiments, as shown in FIG. 9, the pixel circuit 20 may also include a second reset module 24. The second reset module 24 is electrically connected to a control terminal of the driving submodule 211. The second reset module 24 is configured to reset the control terminal of the driving submodule 211. In one embodiment, the control terminal of the second reset module 24 may be electrically connected to a first scan signal terminal SCAN1.

Figure 10:
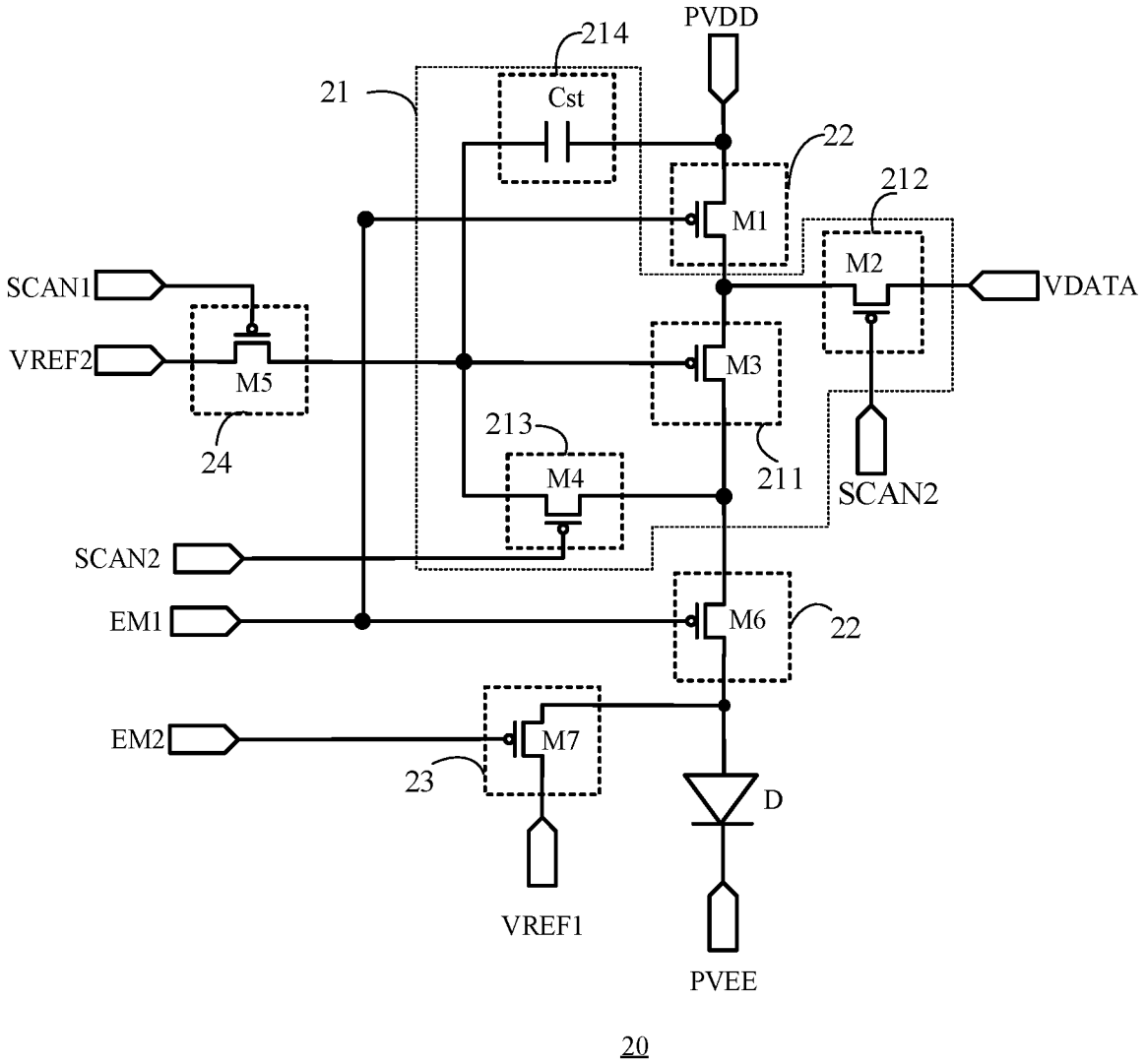
FIG. 10 illustrates another schematic structural diagram of a pixel circuit consistent with the disclosed embodiments of the present disclosure.

FIG. 10 illustrates another schematic structural diagram of a pixel circuit. In some embodiments, as shown in FIG. 10, the light-emitting control module 22 includes a first transistor M1 and a sixth transistor M6. The data writing submodule 212 includes a second transistor M2. The driving submodule 211 includes a third transistor M3. The threshold compensation submodule 213 includes a fourth transistor M4. The second reset module 24 includes a fifth transistor M5. The first reset module 23 includes a seventh transistor M7. The storage submodule 214 includes a storage capacitor Cst.

Gates of the first transistor M1 and the sixth transistor M6 are configured to receive the first light-emitting control signal em1. In one embodiment, the gates of the first transistor M1 and the sixth transistor M6 are each electrically connected to the first output signal terminal EM1. The first terminal of the first transistor M1 is electrically connected to the power voltage terminal PVDD, and the second terminal of the first transistor M1 is electrically connected to the first terminal of the third transistor M3. The first terminal of the sixth transistor M6 is electrically connected to the second terminal of the third transistor M3, and the second terminal of the sixth transistor M6 is electrically connected to the first terminal of the light-emitting element D.

Gates of the second transistor M2 and the fourth transistor M4 are each electrically connected to the second scan signal terminal SCAN2. The first terminal of the second transistor M2 is electrically connected to the data signal terminal VDATA. The second terminal of the second transistor M2 is electrically connected to the first terminal of the third transistor M3. The first terminal of the fourth transistor M4 is electrically connected to the second terminal of the third transistor M3, and the second terminal of the fourth transistor M4 is electrically connected to the gate of the third transistor M3.

The gate of the seventh transistor M7 is configured to receive the second light-emitting control signal em2. In one embodiment, the gate of the seventh transistor M7 is electrically connected to the second output signal terminal EM2. The first terminal of the seventh transistor M7 is electrically connected to a first reset signal terminal VREF1. The second terminal of the seventh transistor M7 is electrically connected to the first terminal of the light-emitting element D.

The gate of the fifth transistor M5 is electrically connected to the first scan signal terminal SCAN1. The first terminal of the fifth transistor M5 is electrically connected to the second reset signal terminal VREF2. The second terminal of the fifth transistor M5 is electrically connected to the gate of the third transistor M3.

The first electrode of the storage capacitor Cst is electrically connected to the power voltage terminal PVDD. The second electrode of the storage capacitor Cst is electrically connected to the gate of the third transistor M3. The second terminal of the light-emitting element D is electrically connected to the common voltage terminal PVEE.

Each transistor in the pixel circuit 20 may have a same type. In one embodiment, each transistor in the pixel circuit is a P-type transistor. In some other embodiments, each transistor in the pixel circuit is an N-type transistor.

Figure 11:
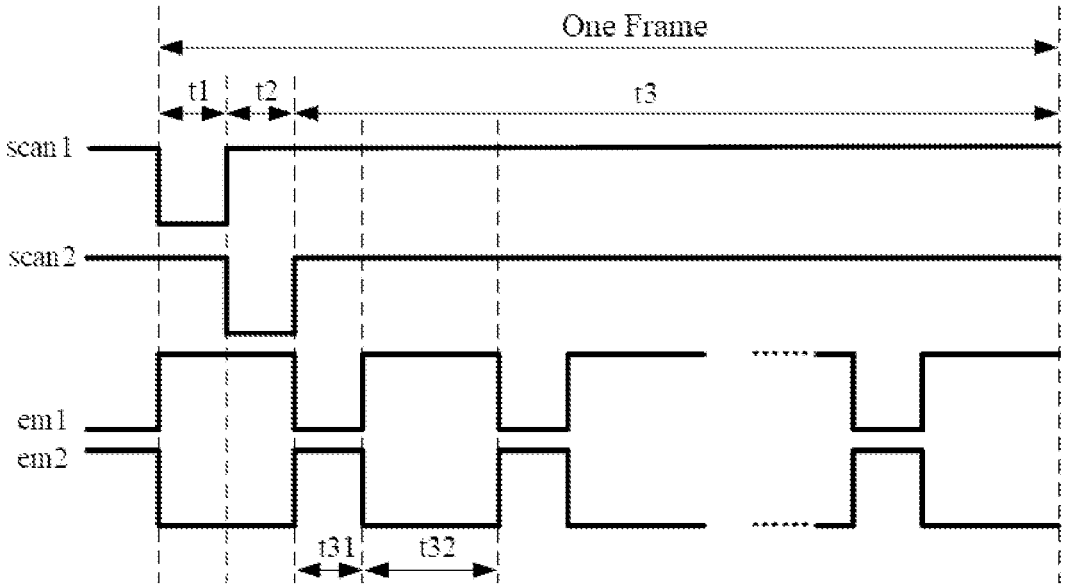
FIG. 11 illustrates a timing diagram of FIG. 10.

FIG. 11 illustrates a timing diagram of FIG. 10. In one embodiment, each transistor in the pixel circuit is a P-type transistor. In the timing diagram shown in FIG. 11, the t1 stage is a reset stage of the gate of the driving transistor, and the third transistor M3 is the driving transistor. The t2 stage is a data writing stage. The t3 stage is an intermittent lighting stage, and the t3 stage includes a t31 stage and a t32 stage. The t31 stage is an effective light-emitting stage, and the t32 stage is an extinguishing stage. The t32 stage is also a reset stage of the light-emitting element.

In the t1 stage, the first scan signal scan1 provided by the first scan signal terminal SCAN1 has a low voltage, and the fifth transistor M5 is turned on. The reset signal of the second reset signal terminal VREF2 is written into the gate of the third transistor M3, thus resetting the gate of the third transistor M3.

In the t2 stage, the second scan signal scan2 provided by the second scan signal terminal SCAN2 has a low voltage. The second transistor M2 and the fourth transistor M4 are turned on. The data voltage of the data signal terminal VDATA is written into the gate of the third transistor M3.

In the t31 stage, the first light-emitting control signal em1 provided by the first output signal terminal EM1 has a low voltage. The first transistor M1 and the sixth transistor M6 are turned on. The driving current is transmitted to the light-emitting element D, and the light-emitting element D emits light.

In the t32 stage, the first light-emitting control signal em1 provided by the first output signal terminal EM1 has a high voltage. The first transistor M1 and the sixth transistor M6 are turned off, and the light-emitting element D is turned off. The second light-emitting control signal em2 provided by the second output signal terminal EM2 has a low voltage, and the seventh transistor M7 is turned on. The reset signal of the first reset signal terminal VREF1 is written into the first terminal of the light-emitting element D, resetting the first terminal of the light-emitting element D.

In addition, in the t1 stage and the t2 stage, the second light-emitting control signal em2 provided by the second output signal terminal EM2 has a low voltage, and the seventh transistor M7 is turned on. The reset signal of the first reset signal terminal VREF1 is written into the first terminal of the light-emitting element D, resetting the first terminal of the light-emitting element D.

In other words, during the non-light-emitting stage within a time length of a frame, the first reset module 23 keeps on resetting the light-emitting element D. Accordingly, the anode of the light-emitting element D may be prevented from accumulating charge due to leakage current. As a result, some light-emitting units may be prevented from stealthily emitting light at time when these light-emitting units should not emit light, and color cast of the display panel may thus be avoided.

As shown in FIG. 9 or FIG. 10, the first reset module 23 and the second reset module 24 are electrically connected to different reset signal terminals, such that the reset signals required by the first reset module 23 and the second reset module 24 may be individually controlled. In some other embodiments, the first reset signal terminal VREF1 may be multiplexed as the second reset signal terminal VREF2. That is, the first reset module 23 and the second reset module 24 may be electrically connected to a same reset signal terminal, and a quantity of reset signal terminals may thus be reduced.

Figure 12:
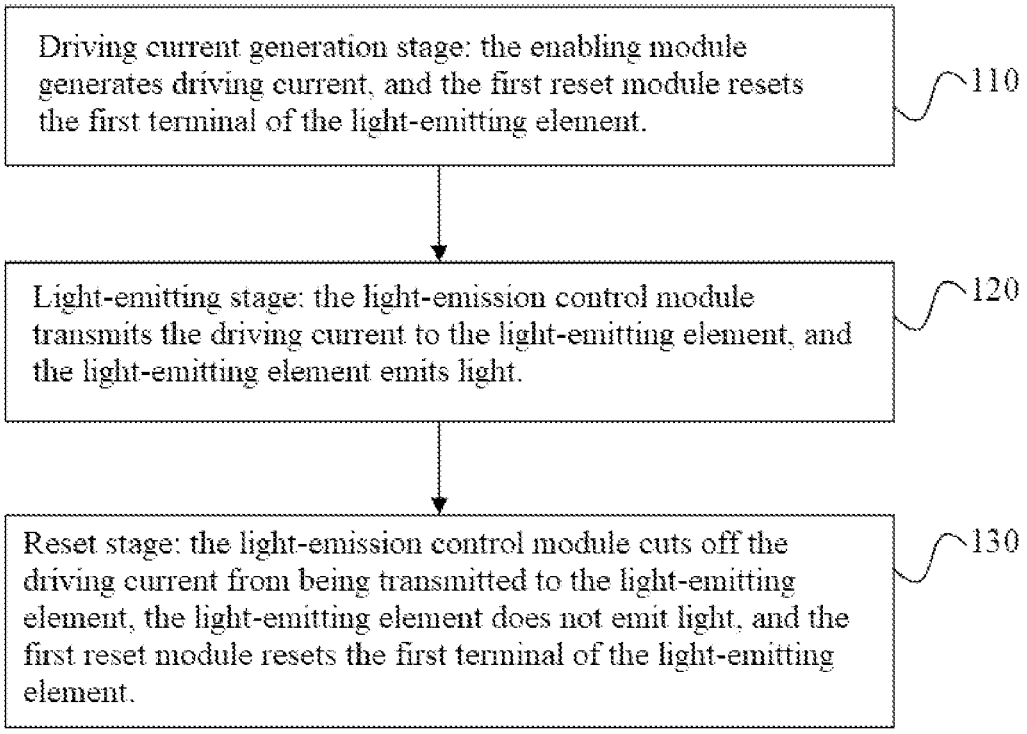
FIG. 12 illustrates a flowchart of a driving method of a pixel circuit consistent with the disclosed embodiments of the present disclosure.

The present application also provides a driving method of a pixel circuit. The driving method may be to drive a pixel circuit 20 provided by the present disclosure. FIG. 12 illustrates a flowchart of a driving method of a pixel circuit. As shown in FIG. 12, the driving method of a pixel circuit provided by of the present application includes step 110 to step 130.

The step 110 includes a driving current generation stage. In the driving current generation stage, the enabling module generates a driving current, and the first reset module resets the first terminal of the light-emitting element.

The step 120 includes a light-emitting stage. In the light-emitting stage, the light-emitting control module transmits driving current to the light-emitting element, and the light-emitting element emits light.

The step 130 includes a reset stage. In the reset stage, the light-emitting control module cuts off the driving current from being transmitted to the light-emitting element. The light-emitting element does not emit light, and the first reset module resets the first terminal of the light-emitting element.

In one embodiment, with reference to FIG. 11, the driving current generation stage may be the t2 stage. In the t2 stage, the enabling module generates a driving current, and the first reset module resets the first terminal of the light-emitting element. The light-emitting stage may be the t31 stage. In the t31 stage, the light-emitting control module is turned on, and the light-emitting element emits light. The reset stage may include the t1 stage and the t32 stage. In other words, within a time length of a frame, except the light-emitting stage, the rest is a non-light-emitting stage. In the non-light-emitting stage, the first reset module resets the first terminal of the light-emitting element. That is, within a time length of a frame, when the light-emitting element does not emit light, the first reset module may keep on resetting the light-emitting element. Accordingly, the anode of the light-emitting element may be prevented from accumulating charge due to leakage current. In this way, some light-emitting elements may be prevented from stealthily emitting light when these light-emitting elements should not emit light, and color cast of the display panel may thus be avoided.

In some embodiments, the light-emitting stage and the resetting stage are alternately executed within a time length of a frame. Accordingly, the light-emitting element is alternately in a non-light-emitting state and a light-emitting state. Thus, the light-emitting time of the light-emitting element may be reduced to decrease the light-emitting brightness of the light-emitting element, and meanwhile, light-emitting uniformity of the light-emitting element within a time length of a frame may be improved.

Figure 13:
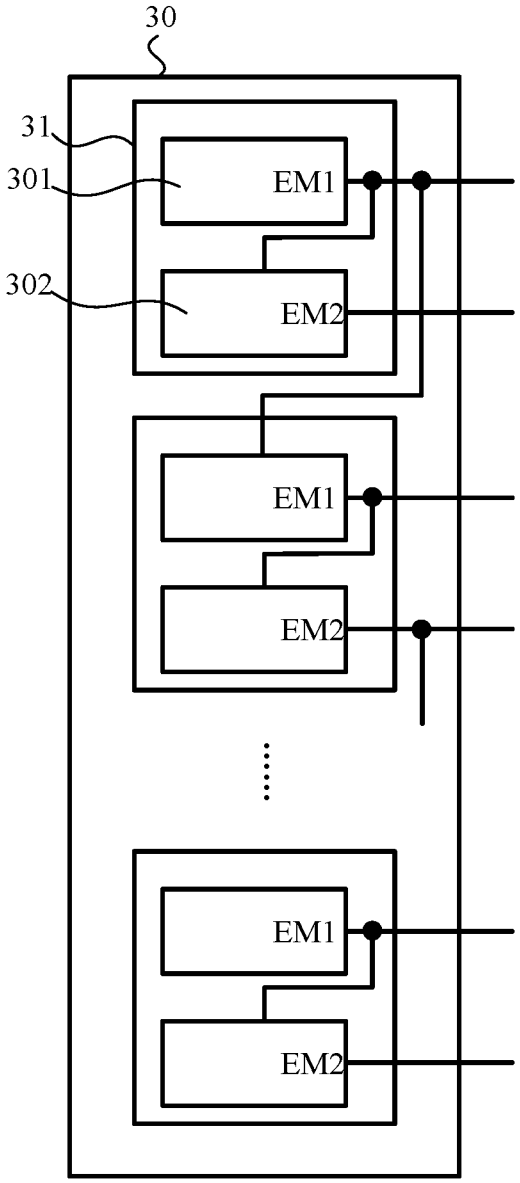
FIG. 13 illustrates a schematic structural diagram of a light-emitting control circuit consistent with the disclosed embodiments of the present disclosure.

The present disclosure also provides a light-emitting control circuit. FIG. 13 illustrates a schematic structural diagram of a light-emitting control circuit consistent with the disclosed embodiments of the present disclosure. As shown in FIG. 13, the light-emitting control circuit 30 includes a plurality of shift registers 31 connected in cascade. A shift register 31 of the plurality of shift registers 31 includes an output control module 301 and an inversion control module 302. The output control module 301 includes a first output signal terminal EM1, and the inversion control module 302 includes a second output signal terminal EM2. The first output signal terminal EM1 is electrically connected to a control terminal of the inversion control module 302. The first output signal terminal EM1 is electrically connected to the control terminal of one of the light-emitting control module 22 and the first reset module 23 in any one of the embodiments above, and the second output signal terminal EM2 is electrically connected to the control terminal of an other of the light-emitting control module 22 and the first reset module 23 in any one of the embodiments above.

Figure 14:
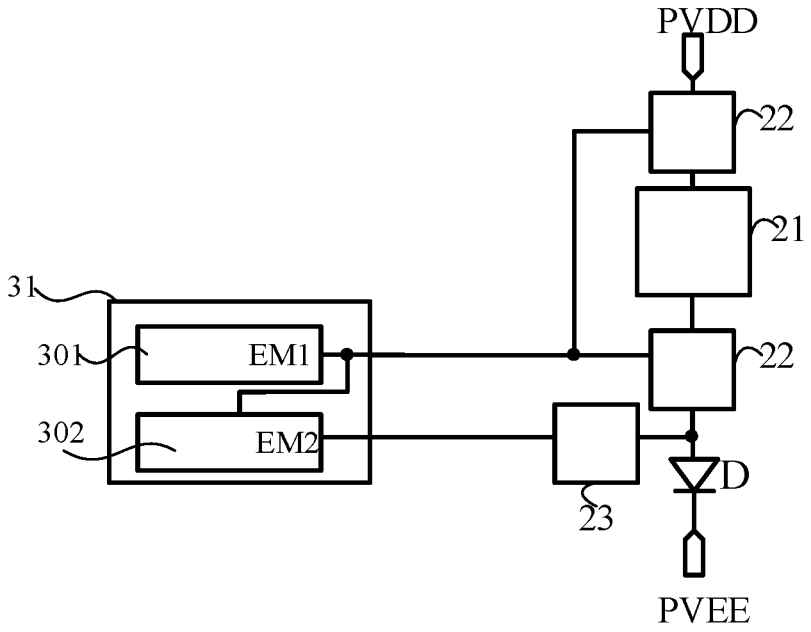
FIG. 14 illustrates a schematic diagram of connection between a shift register and a pixel circuit, consistent with the disclosed embodiments of the present disclosure.

FIG. 14 illustrates a schematic diagram of connection between a shift register and a pixel circuit. As shown in FIG. 14, in one embodiment, as an example, the first output signal terminal EM1 is electrically connected to the control terminal of the light-emitting control module 22, and the second output signal terminal EM2 is electrically connected to the control terminal of the first reset module 23. FIG. 14 does not limit the present disclosure.

Figure 15:
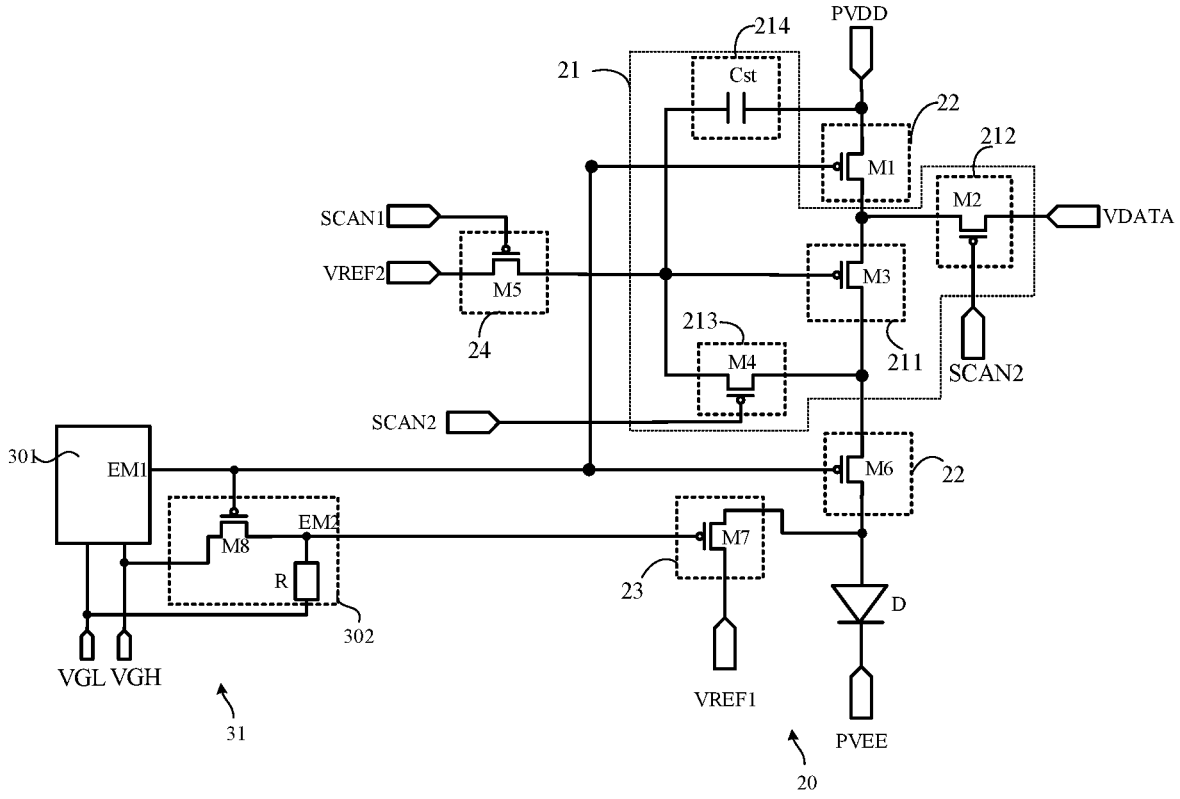
FIG. 15 illustrates a schematic structural diagram of a shift register consistent with the disclosed embodiments of the present disclosure.

FIG. 15 illustrates a schematic structural diagram of a shift register. In some embodiments, as shown in FIG. 15, the light-emitting control circuit includes a first voltage terminal VGH and a second voltage terminal VGL electrically connected to the shift register. The first voltage terminal VGH and the second voltage terminal VGL respectively provide voltage for the inversion control module 302. The inversion control module 302 includes an eighth transistor M8 and a resistor R. A gate of the eighth transistor M8 is electrically connected to the first output signal terminal EM1 of the output control module 301. A first terminal of the eighth transistor M8 is electrically connected to the first voltage terminal VGH, and a second terminal of the eighth transistor M8 is electrically connected to the second output signal terminal EM2. One terminal of the resistor R is electrically connected to the second voltage terminal VGL, and an other end of the resistor R is electrically connected to the second output signal terminal EM2.

In one embodiment, as an example, the transistors in the light-emitting control module 22 and the first reset module 23 are each a P-type transistor, or an N-type transistor. The eighth transistor M8 is a P-type transistor. As an example, the voltage level of the first voltage terminal VGH is higher than the voltage level of the second voltage terminal VGL. When the first output signal terminal EM1 outputs a high voltage, the eighth transistor M8 is turned off. The low voltage of the second voltage terminal VGL is transmitted to the second output signal terminal EM2 through the resistor R, and the second output signal terminal EM2 outputs a low voltage. Accordingly, one of the light-emitting control module 22 and the first reset module 23 is turned on, and an other is turned off. When the first output signal terminal EM1 outputs a low voltage, the eighth transistor M8 is turned on, the high voltage of the first voltage terminal VGH is transmitted to the second output signal terminal EM2 through the eighth transistor M8, and the second output signal terminal EM2 outputs a high voltage. Accordingly, one of the light-emitting control module 22 and the first reset module 23 is turned on, and an other is turned off. As such, only one transistor and one resistor are needed to form an inversion control module. This configuration has a relatively simple structure.

In some other embodiments, the output control module 301 may include a plurality of transistors. Each transistor of the plurality of transistors in the output control module 301 and the eighth transistor M8 is a P-type transistor. A P-type transistor may have a relatively simple process, and thus process difficulty of the output control module 301 may be reduced.

In addition, the present disclosure does not limit a specific structure of the output control module 301, provided that the output control module may output a light-emitting control signal.

Figure 16:
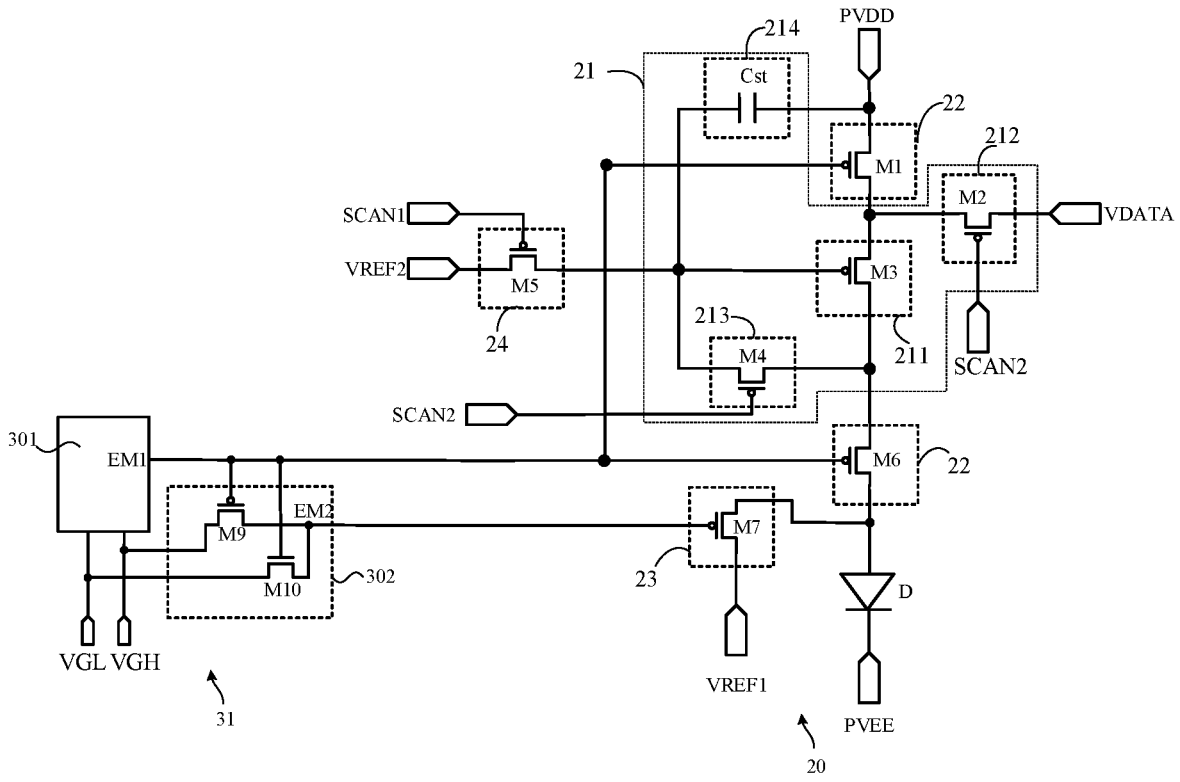
FIG. 16 illustrates another schematic structural diagram of a shift register consistent with the disclosed embodiments of the present disclosure.

FIG. 16 illustrates another schematic structural diagram of a shift register. In some other embodiments, as shown in FIG. 16, the inversion control module 302 includes a ninth transistor M9 and a tenth transistor M10. Gates of the ninth transistor M9 and the tenth transistor M10 are electrically connected to the first output signal terminal EM1. The first terminal of the ninth transistor M9 is electrically connected to the first voltage terminal VGH, and the second terminal of the ninth transistor M9 is electrically connected to the second output signal terminal EM2. The first terminal of the tenth transistor M10 is electrically connected to the second voltage terminal VGL, and the second terminal of the tenth transistor M10 is electrically connected to the second output signal terminal EM2. The ninth transistor M9 is a P-type transistor, and the tenth transistor M10 is an N-type transistor.

In one embodiment, as an example, the transistors in the light-emitting control module 22 and the first reset module 23 are each a P-type transistor or an N-type transistor, and the voltage level of the first voltage terminal VGH is higher than the voltage level of the second voltage terminal VGL. When the first output signal terminal EM1 outputs a high voltage, the ninth transistor M9 is turned off, and the tenth transistor M10 is turned on. The low voltage of the second voltage terminal VGL is transmitted to the second output signal terminal EM2 through the tenth transistor M10, and the second output signal terminal EM2 outputs a low voltage. Accordingly, one of the light-emitting control module 22 and the first reset module 23 is turned on, and an other is turned off. When the first output signal terminal EM1 outputs a low voltage, the ninth transistor M9 is turned on, and the tenth transistor M10 is turned off. The high level of the first voltage terminal VGH is transmitted to the second output signal terminal EM2 through the ninth transistor M9, and the second output signal terminal EM2 outputs a high voltage. Accordingly, one of the light-emitting control module 22 and the first reset module 23 is turned on, and an other is turned off.

As an example, the voltage level of the first voltage terminal VGH may be set to be higher than the voltage level of the second voltage terminal VGL. In one embodiment, the voltage level of the first voltage terminal VGH may be 7V, and the voltage level of the second voltage terminal VGL may be −7V. The voltage levels of the first voltage terminal VGH and the second voltage terminal VGL may be set according to actual requirements. The present disclosure does not limit the voltage levels of the first voltage terminal VGH and the second voltage terminal VGL.

In addition, the output control module 301 and the inversion control module 302 are each electrically connected to the first voltage terminal VGH and the second voltage terminal VGL. The first voltage terminal VGH serves as one signal input terminal of the output control module 301 and the inversion control module 302 at a same time, and provides a first voltage signal for the output control module 301 and the inversion control module 302. The second voltage terminal VGL serves as an other signal input terminal of the output control module 301 and the inversion control module 302 at a same time, and provides a second voltage signal for the output control module 301 and the inversion control module 302.

Figure 17:
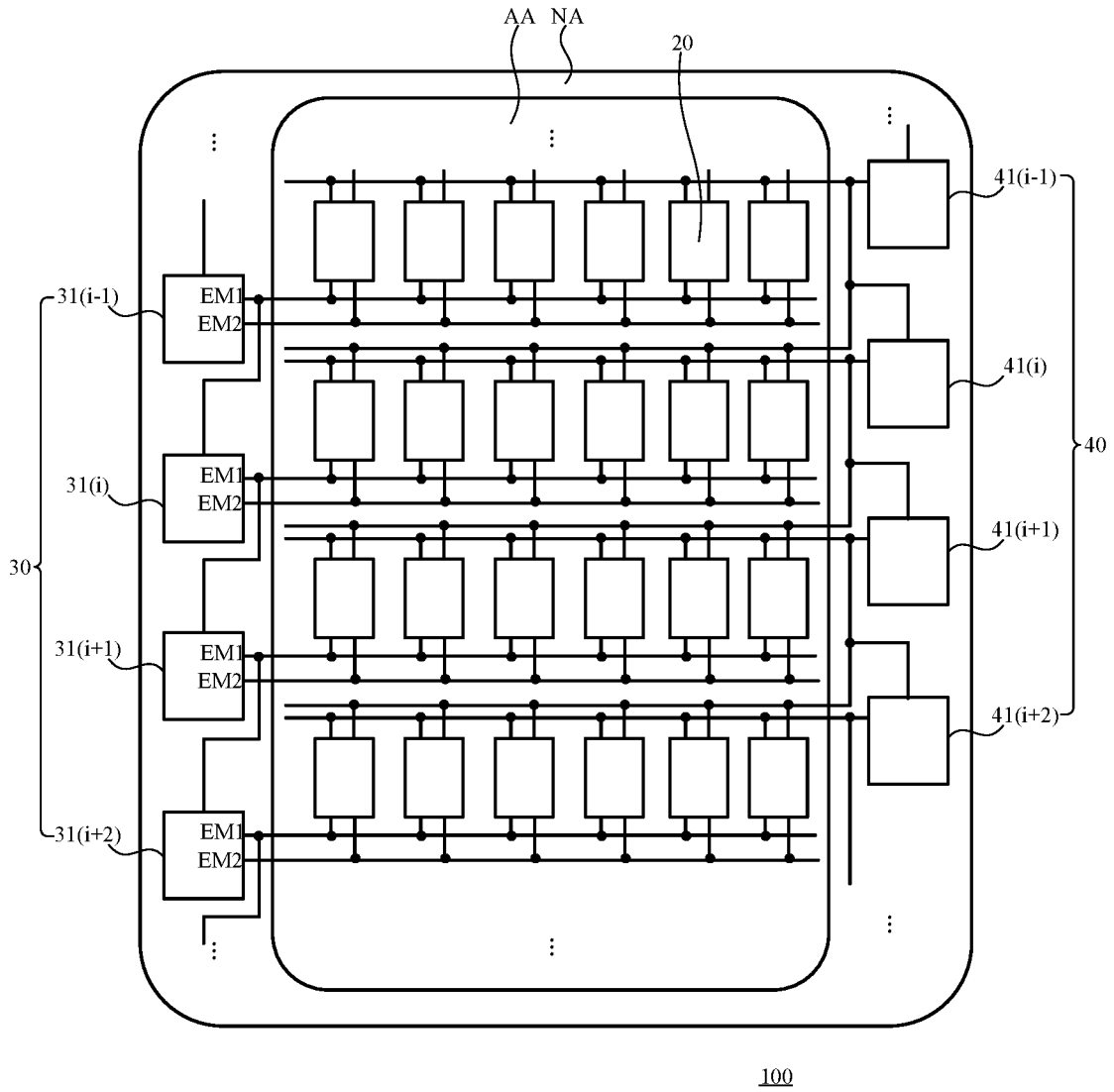
FIG. 17 illustrates a schematic structural diagram of a display panel consistent with the disclosed embodiments of the present disclosure.

The present disclosure provides a display panel. FIG. 17 illustrates a schematic structural diagram of a display panel consistent with the disclosed embodiments of the present disclosure. As shown in FIG. 17, the display panel 100 provided by the present disclosure includes a pixel circuit 20 and a light-emitting control circuit 30.

With reference to FIG. 4, the pixel circuit 20 includes an enabling module 21, a light-emitting control module 22, a first reset module 23, and a light-emitting element D. The enabling module 21, the light-emitting control module 22, and the light-emitting element D are connected in series between the power voltage terminal PVDD and the common voltage terminal PVEE. The first reset module 23 is electrically connected to the first terminal of the light-emitting element D. The enabling module 21 is configured to generate driving current, and the light-emitting control module 22 is configured to transmit the driving current to the light-emitting element D. The first reset module 23 is configured to reset the first terminal of the light-emitting element D.

The control terminal of the light-emitting control module 22 is configured to receive the first light-emitting control signal em1, and the control terminal of the first reset module 23 is configured to receive the second light-emitting control signal em2. The first light-emitting control signal em1 and the second light-emitting control signal em2 are generated by the light-emitting control circuit 30. When the light-emitting control module 22 is in a turn-off state, the first reset module 23 is in a turn-on state. When the light-emitting control module 22 is in a turn-on state, the first reset module 23 is in a turn-off state. In other words, states of the light-emitting control module 22 and the first reset module 23 are opposite at a same time.

With reference to FIG. 13 and FIG. 14, the light-emitting control circuit 30 includes a plurality of shift registers 31 connected in cascade. Each shift register 31 of the plurality of shift registers 31 includes an output control module 301 and an inversion control module 302. The output control module 301 includes a first output signal terminal EM1, and the inversion control module 302 includes a second output signal terminal EM2. The first output signal terminal EM1 is electrically connected to the control terminal of the inversion control module 302. The first output signal terminal EM1 in the shift register 31 is electrically connected to a control terminal of one of the light-emitting control module 22 and the first reset module 23 in the pixel circuit 20. The second output signal terminal EM2 in the shift register 31 is electrically connected to a control terminal of an other of the light-emitting control module 22 and the first reset module 23 in the pixel circuit 20.

In one embodiment, as shown in FIG. 14, the first output signal terminal EM1 is electrically connected to the light-emitting control module 22 in the pixel circuit 20, and the second output signal terminal EM2 is electrically connected to the first reset module 23 in the pixel circuit 20. That is, the first output signal terminal EM1 outputs the first light-emitting control signal em1, and the second output signal terminal EM2 outputs the second light-emitting control signal em2.

In the display panel provided by the present disclosure, on one hand, the first light-emitting control signal received by the control terminal of the light-emitting control module and the second light-emitting control signal received by the control terminal of the first reset module are generated by the light-emitting control circuit. Accordingly, the first light-emitting control signal and the second light-emitting control signal are different from the scan signal from the scan driving circuit. On the other hand, when the light-emitting control module is in a turn-on state, the driving current generated by the enabling module may be transmitted to the light-emitting element, and the light-emitting element may emit light. When the light-emitting control module is in a turn-off state, the light-emitting element is in a non-light-emitting state, and the first reset module is in a turn-on state, such that the first reset module may reset the light-emitting element. In other words, when the light-emitting element is in a non-light-emitting state, the first reset module may reset the light-emitting element. Accordingly, the anode of the light-emitting element may be prevented from accumulating charge due to leakage current. In this way, some light-emitting elements may be prevented from stealthily emitting light when these light-emitting elements should not emit light, and color cast of the display panel may thus be avoided.

In one embodiment, the display panel 100 may include a plurality of pixel circuits 20 distributed in an array. The light-emitting control circuit 30 may include a plurality of shift registers 31 connected in cascade. The display panel 100 may also include a scan driving circuit 40, and the scan driving circuit may include a plurality of shift registers 41 connected in cascade. As shown in FIG. 17, the display panel 100 includes a display area AA and a non-display area NA. The plurality of pixel circuit 20 is located in the display area AA, and the plurality of shift register 31 and the plurality of shift register 41 are located in the non-display area NA. FIG. 17 exemplarily shows the pixel circuits 20 of an (i−1)-th row, an i-th row, an (i+1)-th row, and an (i+2)-th row, the shift registers 31 of an (i−1)-th level, an i-th level, an (i+1)-th level, and an (i+2)-th level, and the shift registers 41 of an (i−1)-th level, an i-th level, an (i+1)-th level, and an (i+2)-th level, where i is an integer and i≥2. The first light-emitting control signal and the second light-emitting control signal received by a same pixel circuit 20 are generated by a same shift register 31 in the light-emitting control circuit 30. In one embodiment, the pixel circuit 20 of the i-th row is electrically connected to the first output signal terminal EM1 and the second output signal terminal EM2 of the shift register 31 of the i-th level.

In one embodiment, the first output signal terminal EM1 of the (i−1)-th level shift register 31 is electrically connected to the input signal terminal of the i-th level shift register 31. The signal output from the first output signal terminal EM1 of the (i−1)-th level shift register 31 is used as the starting signal of the i-th level shift register 31. The first output signal terminal EM1 of the i-th level shift register 31 is electrically connected to the input signal terminal of the (i+1)-th level shift register 31. The signal output by the first output signal terminal EM1 of the i-th level shift register 31 is used as the starting signal of the (i+1)-th level shift register 31. In this way, the light-emitting control circuit 30 may output the light-emitting control signal level by level.

In one embodiment, the output signal terminal of the shift register 41 of the (i−1)-th level is electrically connected to the pixel circuits 20 in the (i−1)-th row and the i-th row. The scanning signal output by the shift register 41 of the (i−1)-th level may be used as the second scanning signal of the pixel circuit 20 of the (i−1)-th row and the first scanning signal of the pixel circuit 20 of the i-th row.

Similarly, the output signal terminal of the shift register 41 of the (i−1)-th level is electrically connected to the input signal terminal of the shift register 41 of the i-th stage, and the signal output by the output signal terminal of the shift register 41 of the (i−1)-th level is used as the starting signal of stage shift register 41 of the i-th level. The output signal terminal of the shift register 41 of the i-th level is electrically connected to the input signal terminal of shift register 41 of the (i+1)-th level. The signal output by the output signal terminal of the shift register 41 the i-th level is used as the starting signal of shift register 41 of the (i+1)-th stage. In this way, the scan driving circuit 40 may output scan signals level by level.

In one embodiment, as shown in FIG. 17, one light-emitting control circuit 30 and one scan driving circuit 40 are disposed in the non-display area NA. In some other embodiments, the non-display area NA may also be disposed with two light-emitting control circuits 30, and the two light-emitting control circuits 30 may be located on two sides of the display area AA. The non-display area NA may also be disposed with two scan driving circuits 40, and the two scan driving circuits 40 may be located on two sides of the display area AA. Accordingly, dual driving of the pixel circuits 20 may be realized. FIG. 17 provides an example only, and does not limit the present disclosure.

The pixel circuit in the display panel 100 may be a pixel circuit 20 provided by the present disclosure. The light-emitting control circuit in the display panel 100 may be a light-emitting control circuit 30 provided by the present disclosure. The display panel provided by the present disclosure has beneficial effects of the pixel circuit and the light-emitting control circuit provided by the present disclosure. For details, reference may be made to specific descriptions of the pixel circuit and the light-emitting control circuit provided by the present disclosure.

The light-emitting control module 22 and the first reset module 23 may each include a transistor. In some embodiments, the transistor of the light-emitting control module 22 and the transistor of the first reset module 23 may have a same type. For example, the transistors of the light-emitting control module 22 and the first reset module 23 are each a P-type transistor, or, the transistors of the light-emitting control module 22 and the first reset module 23 are each an N-type transistor. A conduction voltage of the P-type transistor is a low voltage, and a conduction voltage of the N-type transistor is a high voltage. When the transistors in the light-emitting control module 22 and the first reset module 23 are of a same type, to make the light-emitting control module 22 and the first reset module 23 have opposite states simultaneously, voltages of the first light-emitting control signal and the second light-emitting control signal are opposite at a same time.

In some other embodiments, the transistor of the light-emitting control module 22 and the transistor of the first reset module 23 may have different types. One of the light-emitting control module 22 and the first reset module 23 may include a P-type transistor, and an other of the light-emitting control module 22 and the first reset module 23 may include an N-type transistor. For example, the light-emitting control module 22 includes a P-type transistor, and the first reset module 23 includes an N-type transistor. Or, the light-emitting control module 22 includes an N-type transistor, and the first reset module 23 includes a P-type transistor. Since one of the light-emitting control module 22 and the first reset module 23 includes a P-type transistor, and an other of the light-emitting control module 22 and the first reset module 23 includes an N-type transistor, by making the voltages of the first lighting control signal and the second lighting control signal be same at a same time, states of the lighting control module 22 and the first reset module 23 may be opposite simultaneously.

In some embodiments, as shown in FIG. 15, the light-emitting control circuit includes a first voltage terminal VGH and a second voltage terminal VGL electrically connected to the shift register. The first voltage terminal VGH and the second voltage terminal VGL respectively provide voltage for the inversion control module 302. The inversion control module 302 includes an eighth transistor M8 and a resistor R. A gate of the eighth transistor M8 is electrically connected to the first output signal terminal EM1 of the output control module 301. A first terminal of the eighth transistor M8 is electrically connected to the first voltage terminal VGH, and a second terminal of the eighth transistor M8 is electrically connected to the second output signal terminal EM2. One terminal of the resistor R is electrically connected to the second voltage terminal VGL, and an other end of the resistor R is electrically connected to the second output signal terminal EM2.

In one embodiment, as an example, the transistors in the light-emitting control module 22 and the first reset module 23 are each a P-type transistor, or an N-type transistor. The eighth transistor M8 is a P-type transistor. As an example, the voltage level of the first voltage terminal VGH is higher than the voltage level of the second voltage terminal VGL. When the first output signal terminal EM1 outputs a high voltage, the eighth transistor M8 is turned off. The low voltage of the second voltage terminal VGL is transmitted to the second output signal terminal EM2 through the resistor R, and the second output signal terminal EM2 outputs a low voltage. Accordingly, one of the light-emitting control module 22 and the first reset module 23 is turned on, and an other is turned off. When the first output signal terminal EM1 outputs a low voltage, the eighth transistor M8 is turned on, the high voltage of the first voltage terminal VGH is transmitted to the second output signal terminal EM2 through the eighth transistor M8, and the second output signal terminal EM2 outputs a high voltage. Accordingly, one of the light-emitting control module 22 and the first reset module 23 is turned on, and an other is turned off. As such, only one transistor and one resistor are needed to form an inversion control module. This configuration has a relatively simple structure.

Figure 18:
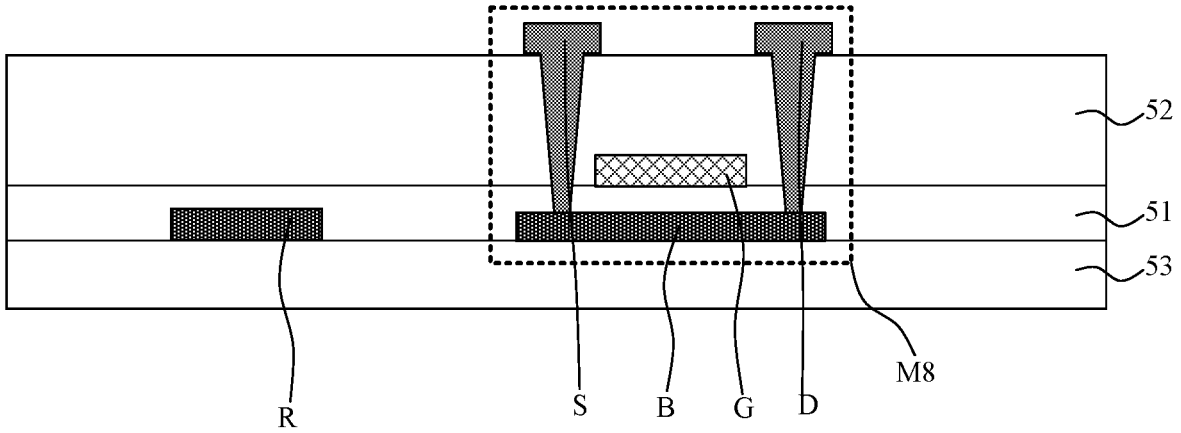
FIG. 18 illustrates a schematic cross-sectional view of a transistor and a resistor consistent with the disclosed embodiments of the present disclosure.

FIG. 18 illustrates a schematic cross-sectional view of a transistor and a resistor. In some embodiments, as shown in FIG. 18, the eighth transistor M8 includes an active layer B. The resistor R and the active layer B are disposed on a same layer, and the resistor R and the active layer B are made of a same material. In this way, the resistor R and the active layer B may be simultaneously formed in a same process, and thus a process flow of the eighth transistor M8 and the resistor R may be simplified.

In one embodiment, the resistor R and the active layer B may be made of amorphous silicon or polysilicon, for example, a-Si or poly-Si.

In one embodiment, the eighth transistor M8 includes a gate G, a source S, and a drain D. In one embodiment, as shown in FIG. 18, the eighth transistor M8 includes a top gate structure. FIG. 8 is not intended to limit the present disclosure.

In one embodiment, as shown in FIG. 18, a first insulating layer 51 may be disposed between the gate G and the active layer B. A second insulating layer 52 may be disposed between the gate G and a layer where the source S and the drain D are located.

Figure 19:
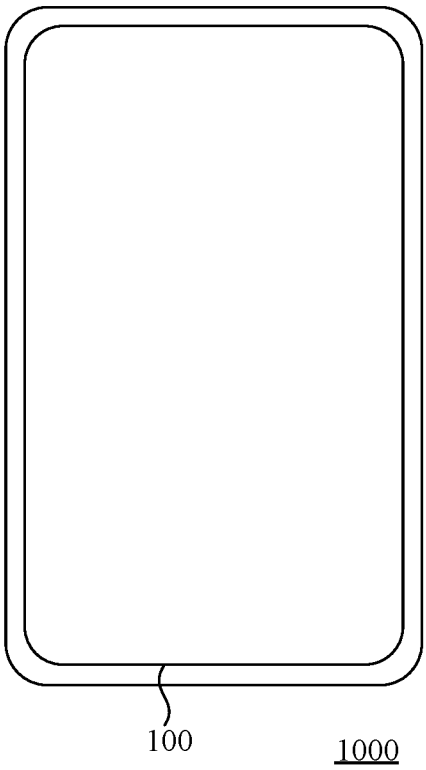
FIG. 19 illustrates a schematic structural diagram of a display device consistent with the disclosed embodiments of the present disclosure.

The present disclosure also provides a display device. The display device includes a display panel provided by the present disclosure. FIG. 19 illustrates a schematic structural diagram of a display device consistent with the disclosed embodiments of the present disclosure. As shown in FIG. 19, the display device 1000 includes a display panel 100 provided by the present disclosure. FIG. 19 only uses a mobile phone as an example to illustrate the display device 1000. It is understandable that the display device provided in the present disclosure may be an other display device with display functions, such as a wearable product, a computer, a television, and an in-vehicle display device. The present disclosure does not have specific limits for the displace device. The display device provided by the present disclosure may have beneficial effects of the display panel provided by the present disclosure. For details, reference may be made to specific descriptions of the display panel provided by the present disclosure.

As disclosed, the technical solutions of the present disclosure have the following advantages.

In the pixel circuit, the light-emitting control circuit, the driving method of a pixel circuit, the display panel, and the display device according to embodiments of the present disclosure, on one hand, the first light-emitting control signal received by the control terminal of the light-emitting control module and the second light-emitting control signal received by the control terminal of the first reset module are generated by the light-emitting control circuit. Accordingly, the first light-emitting control signal and the second light-emitting control signal are different from the scan signal from the scan driving circuit. On the other hand, when the light-emitting control module is in a turn-on state, the driving current generated by the enabling module may be transmitted to the light-emitting element, and the light-emitting element may emit light. When the light-emitting control module is in a turn-off state, the light-emitting element is in a non-light-emitting state, and the first reset module is in a turn-on state, such that the first reset module may reset the light-emitting element. In other words, when the light-emitting element is in a non-light-emitting state, the first reset module may reset the light-emitting element. Accordingly, the anode of the light-emitting element may be prevented from accumulating charge due to leakage current. In this way, some light-emitting elements may be prevented from stealthily emitting light when these light-emitting elements should not emit light, and color cast of the display panel may thus be avoided.

The embodiments disclosed herein are exemplary only and not limiting the scope of this disclosure. Various combinations, alternations, modifications, equivalents, or improvements to the technical solutions of the disclosed embodiments can be obvious to those skilled in the art. Without departing from the spirit and scope of this disclosure, such combinations, alternations, modifications, equivalents, or improvements to the disclosed embodiments are intended to be encompassed within the scope of the present disclosure.

What is claimed is:

1. A pixel circuit, comprising an enabling module, a light-emitting control module, a first reset module, and a light-emitting element, wherein:

the enabling module, the light-emitting control module, and the light-emitting element are connected in series between a power voltage terminal and a common voltage terminal;

the first reset module is electrically connected to a first terminal of the light-emitting element;

the enabling module is configured to generate driving current, and the light-emitting control module is configured to transmit the driving current to the light-emitting element; and the first reset module is configured to reset the first terminal of the light-emitting element, wherein:

a control terminal of the light-emitting control module is configured to receive a first light-emitting control signal, and a control terminal of the first reset module is configured to receive a second light-emitting control signal;

the first light-emitting control signal and the second light-emitting control signal are generated by a light-emitting control circuit; and the light-emitting control module and the first reset module are always at opposite states within a time length of each frame, when the light-emitting control module is at a turn-off state, the first reset module is at a turn-on state, and when the light-emitting control module is at a turn-on state, the first reset module is at a turn-off state.

2. The pixel circuit according to claim 1, wherein:

the light-emitting control circuit include a plurality of shift registers;

each shift register of the plurality of shift registers includes a first output signal terminal for outputting the first light-emitting control signal, and a second output signal terminal for outputting the second light-emitting control signal; and the first light-emitting control signal and the second light-emitting control signal received by a same pixel circuit are generated by a same shift register in the light-emitting control circuit.

3. The pixel circuit according to claim 1, wherein:

transistors of the light-emitting control module and the first reset module have a same type, and voltages of the first light-emitting control signal and the second light-emitting control signal are opposite at a same time; or one of the light-emitting control module and the first reset module includes a P-type transistor, an other of the light-emitting control module and the first reset module includes an N-type transistor, and voltages of the first light-emitting control signal and the second light-emitting control signal are same at a same time.

4. The pixel circuit according to claim 1, wherein:

within the time length of each frame, a time length that the first light-emitting control signal is at a turn-on voltage is shorter than or equal to a time length that the first light-emitting control signal is at a turn-off voltage, and a time length that the second light-emitting control signal is at a turn-on voltage is longer than or equal to a time length that the second light-emitting control signal is at a turn-off voltage.

5. The pixel circuit according to claim 4, wherein:

within the time length of each frame, the first light-emitting control signal includes alternated turn-off and turn-on voltages, and the second light-emitting control signal includes alternated turn-on and turn-off voltages.

6. A driving method, for driving a pixel circuit according to claim 1, comprising:

a driving current generation stage, wherein the enabling module generates driving current, and the first reset module resets the first terminal of the light-emitting element;

a light-emitting stage, wherein the light-emitting control module transmits the driving current to the light-emitting element, and the light-emitting element emits light; and a reset stage, wherein the light-emitting control module cuts off the driving current from being transmitted to the light-emitting element, the light-emitting element does not emit light, and the first reset module resets the first terminal of the light-emitting element.

7. The driving method according to claim 6, further comprising:

within the time length of each frame, controlling the light-emitting stage and the reset stage to be alternately executed.

8. A light-emitting control circuit, comprising a plurality of shift registers connected in cascade, wherein:

a shift register of the plurality of shift registers includes an output control module and an inversion control module;

the output control module includes a first output signal terminal, the inversion control module includes a second output signal terminal, and the first output signal terminal is electrically connected to a control terminal of the inversion control module; and the first output signal terminal is electrically connected to a control terminal of one of a light-emitting control module and a first reset module according to claim 1, and the second output signal terminal is electrically connected to a control terminal of an other of the light-emitting control module and the first reset module according to claim 1.

9. The light-emitting control circuit according to claim 8, wherein:

the inversion control module includes a ninth transistor and a tenth transistor;

gates of the ninth transistor and the tenth transistor are each electrically connected to the first output signal terminal;

a first terminal of the ninth transistor is electrically connected to the first voltage terminal, and a second terminal of the ninth transistor is electrically connected to the second output signal terminal;

a first terminal of the tenth transistor is electrically connected to the second voltage terminal, and a second terminal of the tenth transistor is electrically connected to the second output signal terminal; and the ninth transistor is a P-type transistor, and the tenth transistor is an N-type transistor.

10. The light-emitting control circuit according to claim 8, wherein:

the light-emitting control circuit includes a first voltage terminal and a second voltage terminal electrically connected to the shift register, wherein the first voltage terminal and the second voltage terminal respectively provide voltage for the inversion control module;

the inversion control module includes an eighth transistor and a resistor;

a gate of the eighth transistor is electrically connected to the first output signal terminal of the output control module, a first terminal of the eighth transistor is electrically connected to the first voltage terminal, and a second terminal of the eighth transistor is electrically connected to the second output signal terminal; and one terminal of the resistor is electrically connected to the second voltage terminal, and an other end of the resistor is electrically connected to the second output signal terminal.

11. The light-emitting control circuit according to claim 10, wherein:

all of the plurality of transistors in the output control module and the eighth transistor are P-type transistors.

12. The light-emitting control circuit according to claim 10, wherein:

a voltage level of the first voltage terminal is higher than a voltage level of the second voltage terminal.

13. The pixel circuit according to claim 1, wherein:

the enabling module includes a driving submodule, a data writing submodule, a threshold compensation submodule, and a storage submodule;

the data writing submodule is electrically connected to the driving submodule, and is configured to write data voltage to the driving submodule;

the threshold compensation submodule is electrically connected to a control terminal of the driving submodule, and the threshold compensation submodule is configured to detect and self-compensate threshold voltage deviation in the driving submodule;

the driving submodule is configured to generate driving current according to the data voltage; and the storage submodule is electrically connected to the control terminal of the driving submodule, and the storage submodule is configured to maintain voltage of the control terminal of the driving submodule.

14. The pixel circuit according to claim 13, further comprising a second reset module, wherein:

the second reset module is electrically connected to the control terminal of the driving submodule; and the second reset module is configured to reset the control terminal of the driving submodule.

15. The pixel circuit according to claim 14, wherein:

the light-emitting control module includes a first transistor and a sixth transistor, the data writing submodule includes a second transistor, the driving submodule includes a third transistor, the threshold compensation submodule includes a fourth transistor, the second reset module includes a fifth transistor, the first reset module includes a seventh transistor, and the storage submodule includes a storage capacitor, wherein:

gates of the first transistor and the sixth transistor are each configured to receive the first light-emitting control signal, a first terminal of the first transistor is electrically connected to the power voltage terminal, a second terminal of the first transistor is electrically connected to a first terminal of the third transistor, a first terminal of the sixth transistor is electrically connected to a second terminal of the third transistor, and a second terminal of the sixth transistor is electrically connected to the first terminal of the light-emitting element;

gates of the second transistor and the fourth transistor are each electrically connected to a second scan signal terminal, a first terminal of the second transistor is electrically connected to a data signal terminal, a second terminal of the second transistor is electrically connected to a first terminal of the third transistor, a first terminal of the fourth transistor is electrically connected to a second terminal of the third transistor, and a second terminal of the fourth transistor is electrically connected to a gate of the third transistor;

a gate of the seventh transistor is configured to receive the second light-emitting control signal, a first terminal of the seventh transistor is electrically connected to a first reset signal terminal, and a second terminal of the seventh transistor is electrically connected to the first terminal of the light-emitting element;

a gate of the fifth transistor is electrically connected to a first scan signal terminal, a first terminal of the fifth transistor is electrically connected to a second reset signal terminal, and a second terminal of the fifth transistor is electrically connected to the gate of the third transistor;

a first electrode of the storage capacitor is electrically connected to the power voltage terminal, and a second electrode of the storage capacitor is electrically connected to the gate of the third transistor; and a second terminal of the light-emitting element is electrically connected to the common voltage terminal.

16. The pixel circuit according to claim 15, wherein:

the first reset signal terminal is multiplexed as the second reset signal terminal.

17. A display panel, comprising a pixel circuit and a light-emitting control circuit, wherein:

the pixel circuit includes an enabling module, a light-emitting control module, a first reset module, and a light-emitting element;

the enabling module, the light-emitting control module, and the light-emitting element are connected in series between a power voltage terminal and a common voltage terminal, and the first reset module is electrically connected to a first terminal of the light-emitting element;

the enabling module is configured to generate driving current, the light-emitting control module is configured to transmit the driving current to the light-emitting element, and the first reset module is configured to reset the first terminal of the light-emitting element;

a control terminal of the light-emitting control module is configured to receive a first light-emitting control signal, and a control terminal of the first reset module is configured to receive a second light-emitting control signal;

when the light-emitting control module is in a turn-off state, the first reset module is in a turn-on state, and when the light-emitting control module is in a turn-on state, the first reset module is in a turn-off state;

the light-emitting control circuit includes a plurality of shift registers connected in cascade, and a shift register of the plurality of shift registers includes an output control module and an inversion control module;

the output control module includes a first output signal terminal, the inversion control module includes a second output signal terminal, and the first output signal terminal is electrically connected to a control terminal of the inversion control module; and the first output signal terminal in the shift register is electrically connected to a control terminal of one of the light-emitting control module and the first reset module in the pixel circuit, and the second output signal terminal in the shift register is electrically connected to a control terminal of an other of the light-emitting control module and the first reset module in the pixel circuit.

18. The display panel according to claim 17, wherein:

transistors of the light-emitting control module and the first reset module have a same type, and voltages of the first light-emitting control signal and the second light-emitting control signal are opposite at a same time; or one of the light-emitting control module and the first reset module includes a P-type transistor, an other of the light-emitting control module and the first reset module includes an N-type transistor, and voltages of the first light-emitting control signal and the second light-emitting control signal are same at a same time.

19. The display panel according to claim 17, wherein:

the light-emitting control circuit includes a first voltage terminal and a second voltage terminal electrically connected to the shift register, wherein the first voltage terminal and the second voltage terminal respectively provide voltage for the inversion control module;

the inversion control module includes an eighth transistor and a resistor;

a gate of the eighth transistor is electrically connected to the first output signal terminal of the output control module, a first terminal of the eighth transistor is electrically connected to the first voltage terminal, and a second terminal of the eighth transistor is electrically connected to the second output signal terminal; and one terminal of the resistor is electrically connected to the second voltage terminal, and an other end of the resistor is electrically connected to the second output signal terminal.

20. The display panel according to claim 19, wherein:

the eighth transistor includes an active layer;

the resistor and the active layer are configured in a same layer; and the resistor and the active layer are made of a same material.

21. A display device, comprising a display panel including a pixel circuit and a light-emitting control circuit, wherein:

the pixel circuit includes an enabling module, a light-emitting control module, a first reset module, and a light-emitting element;

the enabling module, the light-emitting control module, and the light-emitting element are connected in series between a power voltage terminal and a common voltage terminal, and the first reset module is electrically connected to a first terminal of the light-emitting element;

the enabling module is configured to generate driving current, the light-emitting control module is configured to transmit the driving current to the light-emitting element, and the first reset module is configured to reset the first terminal of the light-emitting element;

a control terminal of the light-emitting control module is configured to receive a first light-emitting control signal, and a control terminal of the first reset module is configured to receive a second light-emitting control signal;

the light-emitting control module and the first reset module are always at opposite states within a time length of each frame, when the light-emitting control module is in a turn-off state, the first reset module is in a turn-on state, and when the light-emitting control module is in a turn-on state, the first reset module is in a turn-off state;

the light-emitting control circuit includes a plurality of shift registers connected in cascade, and each shift register of the plurality of shift registers includes an output control module and an inversion control module;

the output control module includes a first output signal terminal, the inversion control module includes a second output signal terminal, and the first output signal terminal is electrically connected to a control terminal of the inversion control module; and the first output signal terminal in the shift register is electrically connected to a control terminal of one of the light-emitting control module and the first reset module in the pixel circuit, and the second output signal terminal in the shift register is electrically connected to a control terminal of an other of the light-emitting control module and the first reset module in the pixel circuit.

* * * * *